US012102171B2

(12) United States Patent
Stockbridge et al.

(10) Patent No.: US 12,102,171 B2
(45) Date of Patent: Oct. 1, 2024

(54) SUPPORTING MEMBER FOR FOOTWEAR ACTIVITY ECONOMY

(71) Applicant: Skechers U.S.A., Inc. II, Manhattan Beach, CA (US)

(72) Inventors: Kurt Stockbridge, Palos Verdes Estates, CA (US); Anthony Dean, Blue Ridge, GA (US); Chih Hsiang Hsu, Taoyuan (TW); Geoffrey Gray, Goleta, CA (US)

( * ) Notice: Subject to any disclaimer, the term of this patent is extended or adjusted under 35 U.S.C. 154(b) by 445 days.

(21) Appl. No.: 17/141,171

(22) Filed: Jan. 4, 2021

(65) Prior Publication Data

US 2021/0137213 A1 May 13, 2021

Related U.S. Application Data

(60) Provisional application No. 62/933,055, filed on Nov. 8, 2019.

(51) Int. Cl.

| | |
|---|---|
| ***A43B 13/14*** | (2006.01) |
| ***A43B 7/145*** | (2022.01) |
| ***A43B 13/16*** | (2006.01) |
| ***A43B 13/18*** | (2006.01) |

(52) U.S. Cl.

CPC ..... *A43B 13/146* (2013.01); *A43B 7/145* (2013.01); *A43B 13/16* (2013.01); *A43B 13/186* (2013.01)

(58) Field of Classification Search

CPC ... A43B 13/181; A43B 13/141; A43B 13/026; A43B 13/12; A43B 13/14; A43B 13/10; A43B 7/145; A43B 7/1445; A43B 7/148; A43B 13/186

USPC ..... 36/107, 88, 91

See application file for complete search history.

(56) References Cited

U.S. PATENT DOCUMENTS

| | | | | |
|---|---|---|---|---|
| 4,506,460 | A | 3/1985 | Rudy | |
| 5,046,267 | A | 9/1991 | Kilgore | |
| 5,218,773 | A | 6/1993 | Beekman | |
| 5,224,280 | A | 7/1993 | Preman | |
| 5,247,742 | A | 9/1993 | Kilgore | |
| 5,297,349 | A | 3/1994 | Kilgore | |
| 5,832,634 | A * | 11/1998 | Wong | A43B 13/187 36/31 |

(Continued)

OTHER PUBLICATIONS

Chan, C.W., & Rudins, A., "Foot biomechanics during walking and running," Mayo Clinic Proceedings, 1994, vol. 69, No. 5, pp. 448-461.

(Continued)

*Primary Examiner* — Jameson D Collier

(57) ABSTRACT

A supporting member in a sole for an article of footwear including at least a vertical sub-member extending in both a vertical direction and a longitudinal direction that extends along a toe region to a heel region of the sole. Located within or adjacent to a cushioning member, the vertical sub-member has a curvature along the longitudinal direction wherein the curvature is configured to reduce flexion of the cushioning element and/or improve the durability of the supporting member. The supporting member further includes a horizontal sub-member extending from a sidewall of the vertical sub-member in a latitudinal direction of the sole and being angled away from the vertical sub-member and at least a portion of the vertical sub-member being coextensive with the vertical sub-member.

17 Claims, 36 Drawing Sheets

(56) References Cited

U.S. PATENT DOCUMENTS

| | | | | |
|---|---|---|---|---|
| 5,918,338 | A * | 7/1999 | Wong | A43B 13/16 12/146 S |
| 6,477,791 | B2 | 11/2002 | Luthi | |
| 6,502,330 | B1 | 1/2003 | David | |
| 7,299,567 | B2 | 11/2007 | Berend | |
| 7,370,443 | B2 | 5/2008 | Gibert | |
| 7,383,647 | B2 | 6/2008 | Chan | |
| 7,434,337 | B2 | 10/2008 | Gibert | |
| 8,171,656 | B2 | 5/2012 | Salminen | |
| 8,191,285 | B2 | 6/2012 | Perron, Jr. | |
| 8,312,647 | B2 | 11/2012 | Hofmann | |
| 8,327,560 | B2 | 12/2012 | Berend | |
| 8,341,856 | B2 | 1/2013 | Smith | |
| 8,695,235 | B2 | 4/2014 | Perron, Jr. | |
| 8,713,817 | B2 | 5/2014 | Litchfield | |
| 9,131,746 | B2 | 9/2015 | Arciuolo | |
| 9,615,626 | B2 | 4/2017 | Rushbrook | |
| 9,775,404 | B2 | 10/2017 | Lyden | |
| 9,930,927 | B2 | 4/2018 | Luedecke | |
| 10,010,137 | B2 | 7/2018 | Foxen | |
| 10,292,451 | B2 | 5/2019 | Beers | |
| 10,441,027 | B2 | 10/2019 | Bartel | |
| 10,448,704 | B2 | 10/2019 | Dupre | |
| 10,512,300 | B2 | 12/2019 | Rushbrook | |
| 10,517,351 | B2 | 12/2019 | Arciuolo | |
| 10,548,368 | B2 | 2/2020 | Bartel | |
| 10,561,198 | B2 | 2/2020 | Luedecke | |
| 10,743,606 | B2 | 8/2020 | Bartel | |
| 10,765,172 | B2 | 9/2020 | Foxen | |
| 10,798,992 | B2 | 10/2020 | Bartel | |
| 2002/0050078 | A1 * | 5/2002 | Dietrich | A43B 7/24 36/31 |
| 2008/0201982 | A1 * | 8/2008 | Aveni | A43B 13/223 36/35 B |
| 2008/0289220 | A1 * | 11/2008 | Rivas | A43B 13/141 36/35 R |
| 2009/0260259 | A1 * | 10/2009 | Berend | A43B 7/1435 36/35 B |
| 2010/0071231 | A1 * | 3/2010 | Murphy | A43B 7/24 36/107 |
| 2015/0013182 | A1 | 1/2015 | Norton | |
| 2017/0095033 | A1 | 4/2017 | Farina | |
| 2018/0055143 | A1 * | 3/2018 | Baucom | A43B 13/183 |
| 2018/0084864 | A1 * | 3/2018 | Takada | A43B 7/1435 |
| 2020/0281314 | A1 * | 9/2020 | Stockbridge | B29D 35/128 |

OTHER PUBLICATIONS

Fuller, J.T. et al., "The Effect of Footwear on Running Performance and Running Economy in Distance Runners," Sports Medicine, Nov. 18, 2014, vol. 45, No. 3, pp. 411-422, Springer International Publishing Switzerland.

Voloshina, A.S. et al., "Biomechanics and energetics of walking on uneven terrain." The Journal of Experimental Biology, 2015, vol. 218, pp. 711-719, The Company of Biologists Ltd.

"Rilsan polyamide 11," Rilsan by Arkema, 2018, Arkema Inc.

* cited by examiner

FIG. 8A
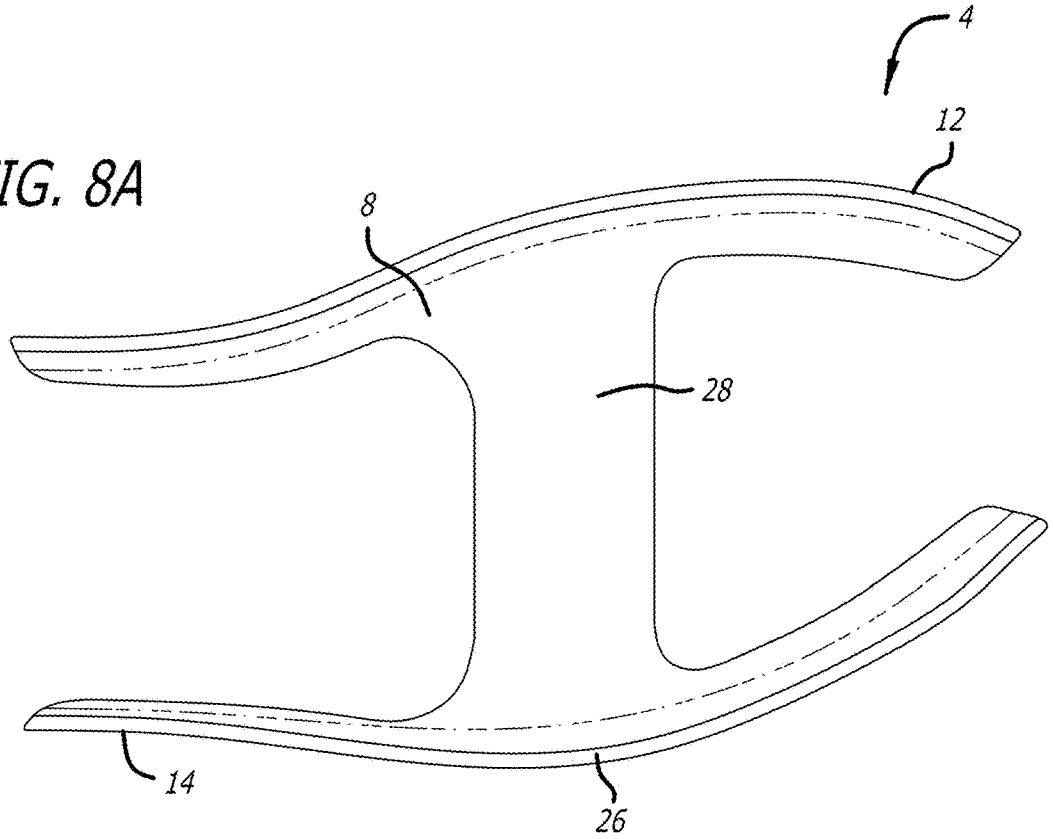
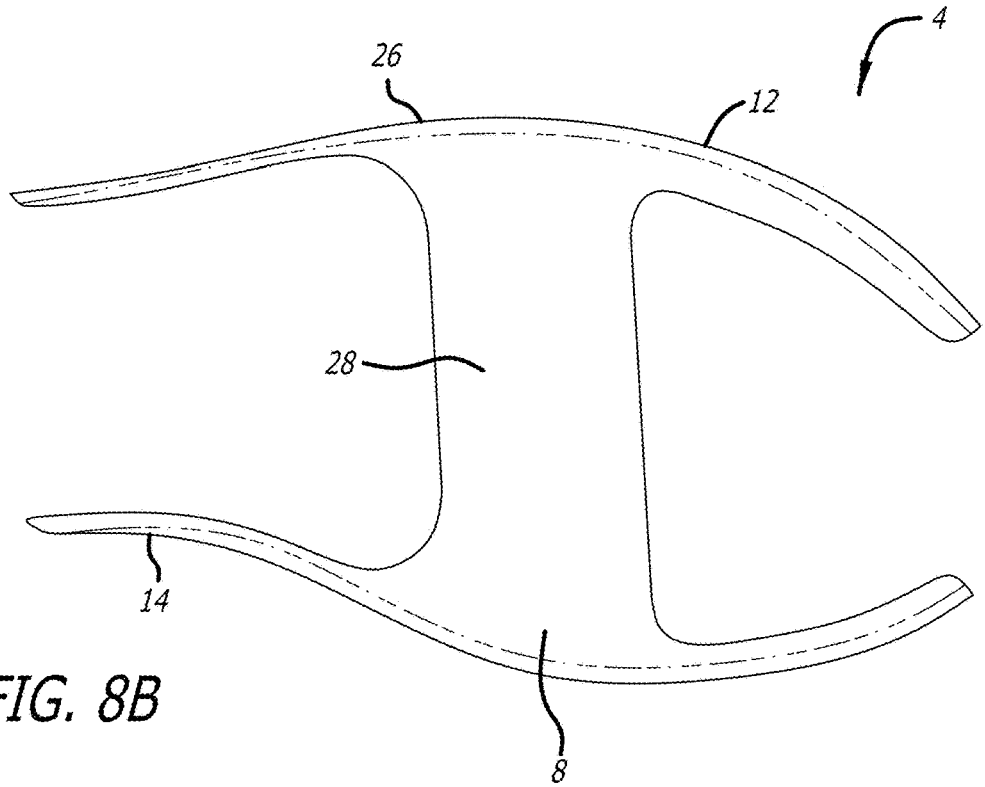
FIG. 8B

FIG. 14C
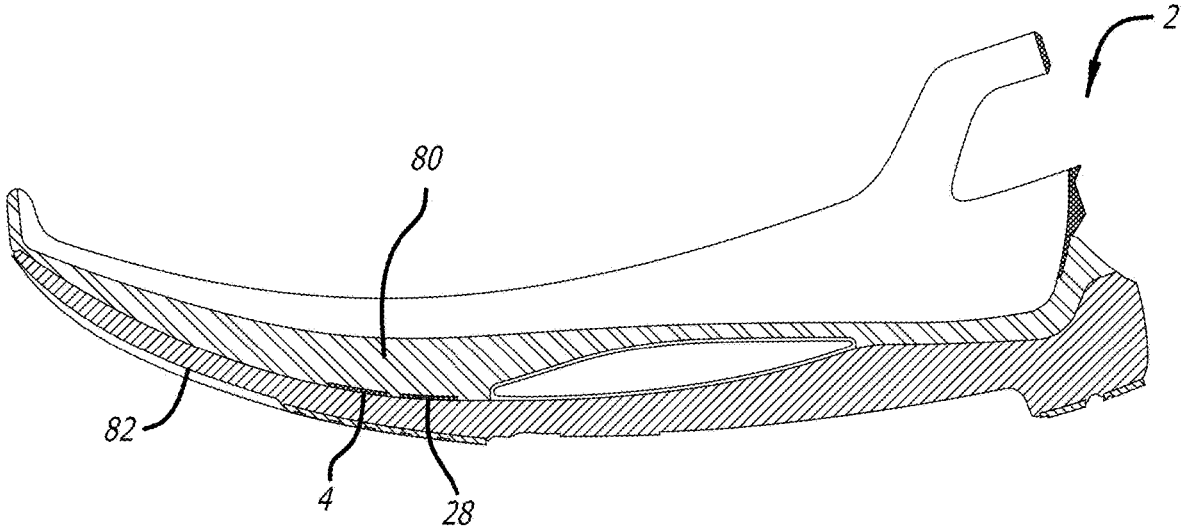
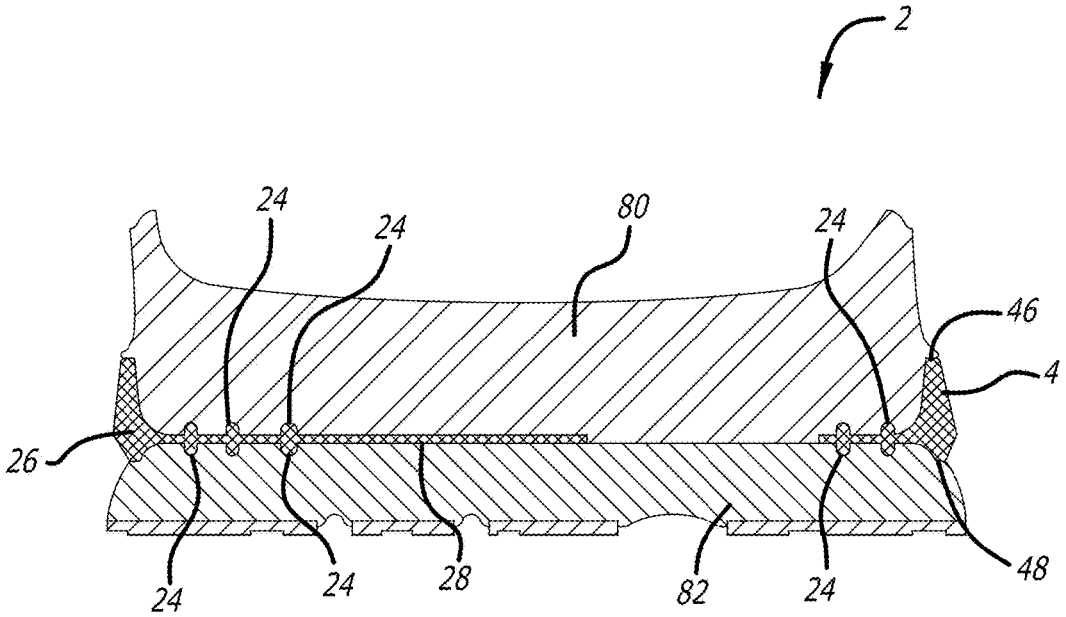
FIG. 14D

SUPPORTING MEMBER FOR FOOTWEAR ACTIVITY ECONOMY

FIELD OF THE INVENTION

The present invention pertains to an article of footwear, and more particularly for a supporting member attached to a cushioning element having a rigid and concave configuration with a vertical dimension in a sole for providing a more durable and lightweight sole for improved walking or running economy.

BACKGROUND OF THE INVENTION

Walking and running economy is defined as the metabolic cost of performing a particular task such as propulsion that occurs during the stance phase of a walking or running gait. Elastic energy storage and return for propulsion and support in tendons and ligaments has been attributed to be as a factor in enhancing such economy which may be achieved by having a firm and compliant sole that is able to absorb the energy and elastic enough to return the energy. Other factors that influence walking or running economy include reducing plantarflexion as the foot pushes off the ground and using a light weight shoe.

However, prior art shoes having plates fail to maximize running economy due to the plates' higher masses. Furthermore, prior art plates that attempt to achieve a lower weight sacrifice the durability of the plate which causes the plate to be ineffective early in its use.

BRIEF SUMMARY OF THE INVENTION

The present invention is a shoe sole, and in particular, a curved and rigid supporting member with a vertical dimension having one or more components that are integrated into a sole. In at least one embodiment, the supporting member may be located at least underneath a region at or near the ball of a foot.

BRIEF DESCRIPTION OF THE DRAWINGS

By way of example only, selected embodiments and aspects of the present invention are described below. Each description refers to a figure ("FIG.") which shows the described matter. Some figures shown in drawings that accompany this specification may be for footwear that is for either the left or right foot. Each figure includes one or more identifiers for one or more part(s) or elements(s) of the invention.

Various embodiments are described with reference to the drawings, in which:

FIG. 8A is a top view of a supporting member.

FIG. 8B is a bottom view of the supporting member shown in FIG. 8A.

FIG. 14C is a cross-sectional view of the sole shown in FIG. 14A, as defined by section line 14C-14C in FIG. 14B.

FIG. 14D is a cross-sectional view of the sole shown in FIG. 14A, as defined by section line 14D-14D in FIG. 14B.

DETAILED DESCRIPTION OF THE INVENTION

Figure 1A:
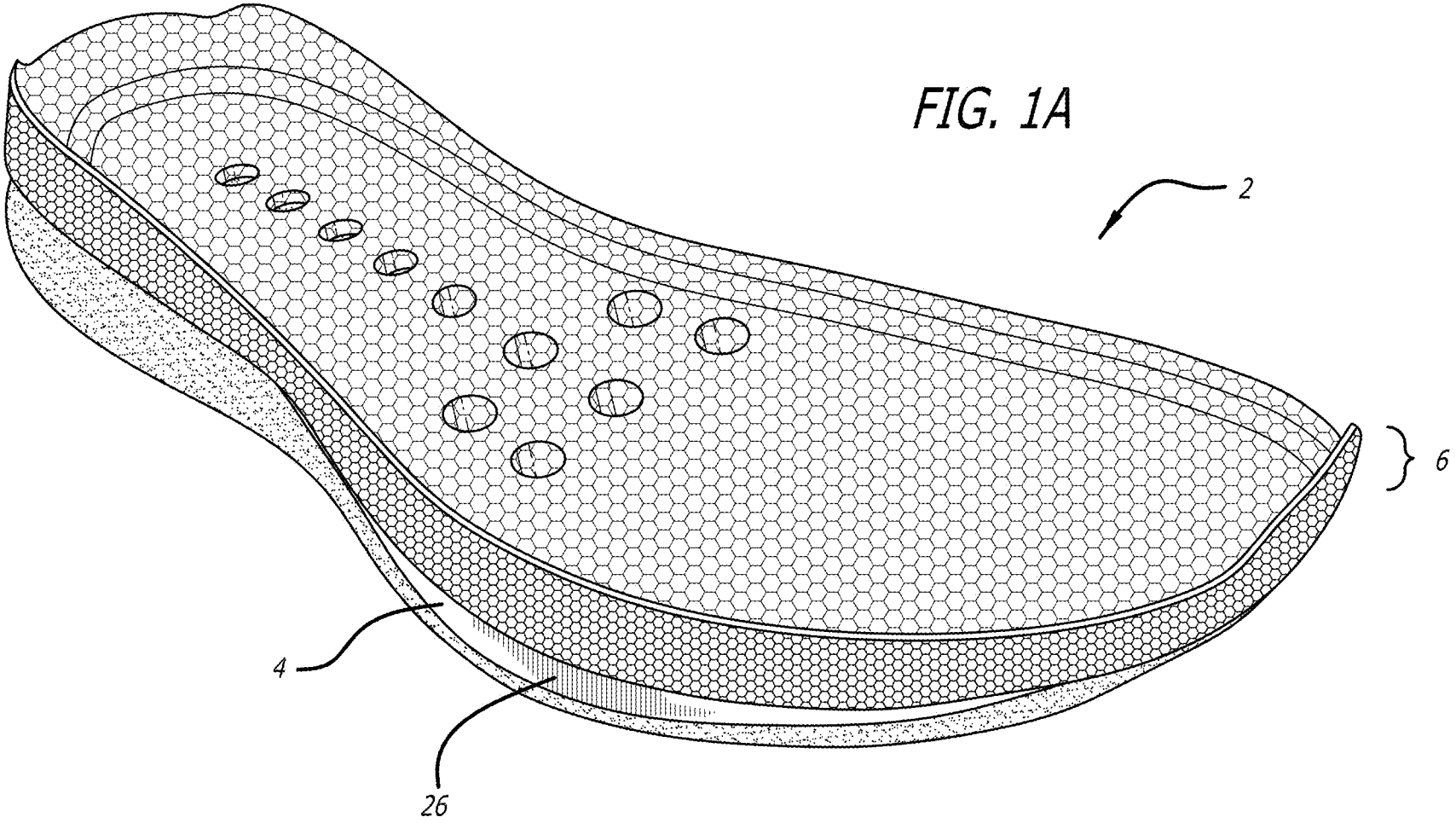
FIG. 1A is a perspective view of a sole having a rigid supporting member.
Figure 1B:
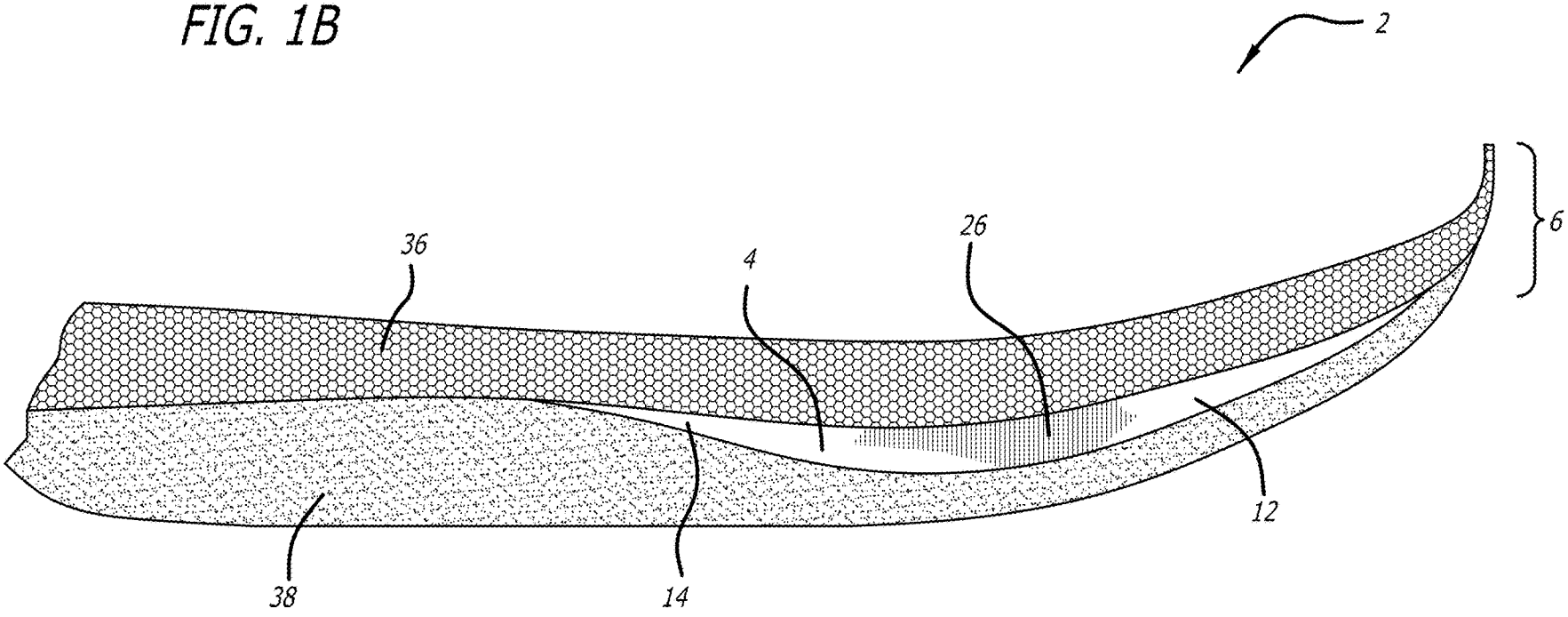
FIG. 1B is a side view of the sole shown in FIG. 1A.
Figure 1C:
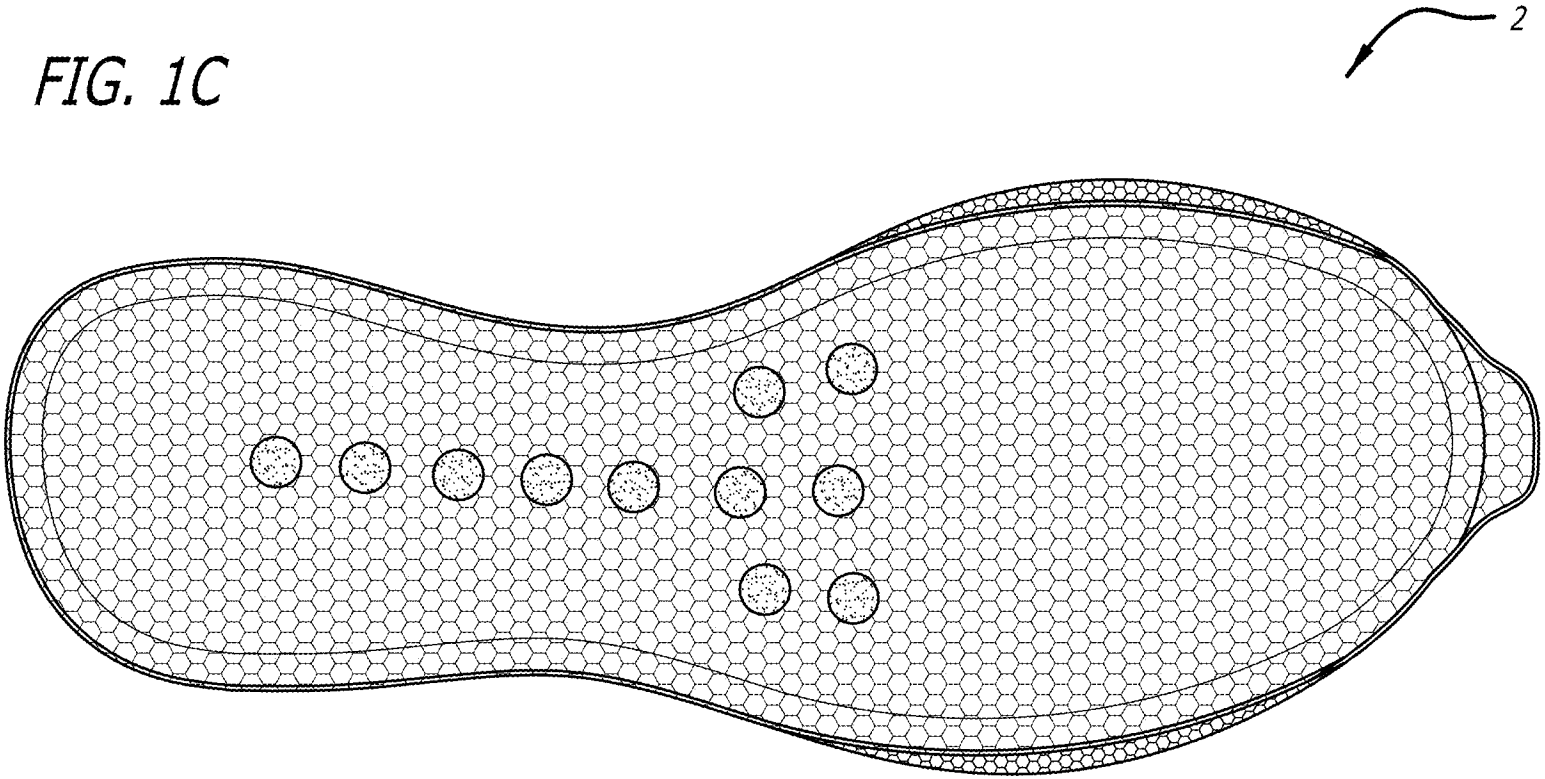
FIG. 1C is a top plan view of the sole shown in FIG. 1A.

Introduction. The present invention is a shoe sole for an article of footwear. Particularly, a shoe sole comprised of a supporting member or a plurality of supporting members located at least underneath a region at or near the ball of a foot. The supporting member includes an anterior portion disposed at or near a forefoot region of the sole and a posterior portion disposed at or near a midfoot region of the sole. The supporting member includes a concave configuration extending from an anterior portion to a posterior portion in a longitudinal direction between the toe end and the heel end of the sole. The supporting member includes a vertical sub-member extending substantially along the longitudinal length of the supporting member and extending in a substantially vertical dimension that extends in the direction from the shoe's upper to the outsole of the shoe.

The design of the supporting member, and more specifically the vertical sub-member of the supporting member, enables the supporting member to exhibit a high degree of stiffness while utilizing a minimal amount of materials, resulting in a high stiffness to weight ratio. Consequently, the supporting member imparts the desired stiffness to a shoe while limiting mass added to the shoe which in turn enhances the economy of the activity of the wearer. Furthermore, the vertical dimension of the vertical sub-member also enhances the durability of the supporting member which extends the effective use of the shoe over a greater distance.

Implementations of the disclosure may include one or more of the following optional features. In some implementations, a supporting member further includes horizontal components such as a horizontal sub-member that is connected to a sidewall of the vertical sub-member. The horizontal sub-member may have a curved conformation and extends in the longitudinal direction of the sole and in the mediolateral direction of the sole. The horizontal sub-member may be located on the interior side of the vertical sub-member or the exterior side of the sub-member or a plurality of horizontal sub-members may be located on both sides of the vertical sub-member. The horizontal sub-member may be configured to be perpendicular to the vertical sub-member in an L-shaped configuration or angled acutely or obtusely from a vertical plane of the vertical sub-member. The horizontal sub-member or vertical sub-member may be integrally connected to a cross bar. The cross bar is configured to substantially extend in the mediolateral direction at a distance further than the horizontal sub-member. The cross bar may provide additional rigidity to regions in the cushioning member.

In some examples, the supporting member may have a top surface and lower surface and there are one or more support ridges above and/or below the top and lower surfaces of the supporting member that extend along the longitudinal length of the supporting member. A ridge may be located on a vertical sub-member, a horizontal sub-member, and/or a cross bar of the supporting member.

While the present invention is referred to as a supporting member, the term is not intended to be limiting and is meant to refer to any structure that may be incorporated into a shoe sole and the structure having the desired rigidity and elasticity properties. Thus, the supporting member can be referred to as a plate, insert, rigid yet compliant structure, spring board, or any other suitable term.

Figure 1D:
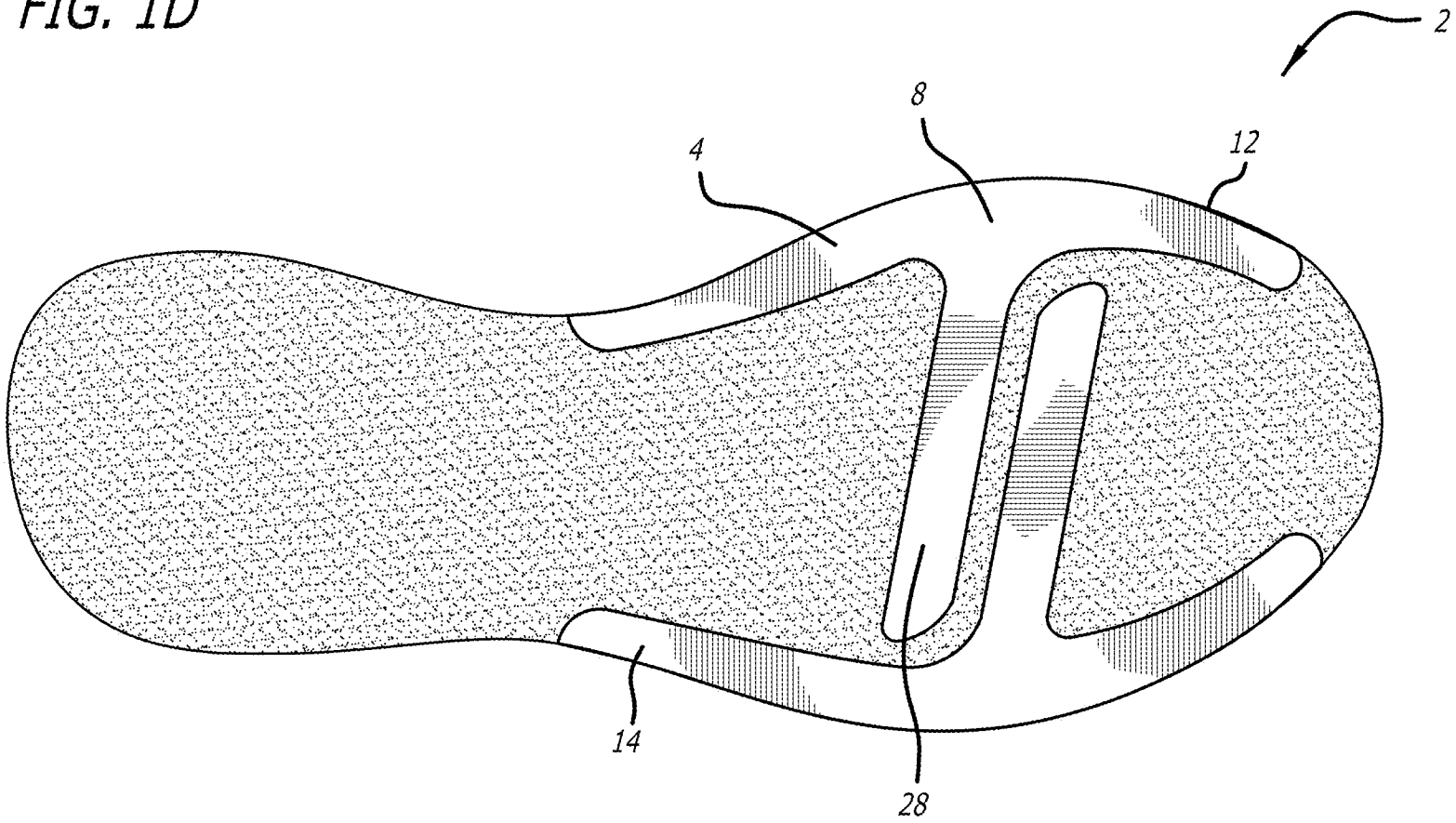
FIG. 1D is a top plan view of the partially assembled sole shown in FIG. 1A.

Supporting Member Placement. The invention will now be first described with reference to the exemplary embodiment shown in FIGS. 1A-1D which shows a perspective view of sole 2 with supporting member 4 having a concave configuration and vertical sub-member 26. Supporting member 4 is sandwiched between first layer 36 and second layer 38 of midsole 6 and configured to be located in the forefoot area of the sole. The supporting member may be a single supporting member or a plurality of supporting members. FIG. 1D shows sole 2 with a pair of supporting members 4 that are spaced away from each other and are primarily located on the medial and lateral sides of sole 2. Spacing the pair of supporting members from each other also allows ease in positioning the supporting member in the sole during manufacturing process. Component parts of a sole often exhibit variance in its dimensions. Spacing apart supporting members enables adjustments in positioning the supporting member to account for such variance.

In other embodiments, the supporting member may also be located above the midsole between a midsole and an upper or the supporting member may be located below the midsole either between a midsole and an outsole or the supporting member may form part of the outsole. The supporting member may also be at least a portion of a sock liner or as part of a lasting board to an upper.

The supporting member may also substantially extend along the longitudinal length of the sole or partially along a portion of the sole. The supporting member may be a plurality of supporting members located at various locations of the sole. The supporting member may be placed in locations of the sole that enhances running or walking economy in areas either by absorbing energy and/or providing elastic energy return.

Supporting Member Curvature. A supporting member may be located in the forefoot region of the sole and has a curvature that extends in the longitudinal direction. There may be a plurality of curvatures in the latitudinal direction and the vertical direction. A plurality of curvatures in the latitudinal and vertical directions may increase the stiffness and durability of the supporting member to reduce flexion in the sole and enable the supporting member to withstand greater loads over prolonged use. The curvature of the latitudinal direction may be at least partially coextensive with the medial or lateral peripheral edge of the sole. The vertical curvature may be concave upward that extends along the longitudinal axis of the sole.

In the exemplary embodiment of FIGS. 1A-1D, the upward curvature has a lowest point of curvature of supporting member 4 that is located around the region at or near the ball of wearer's foot. Supporting member 4 begins near the midfoot region of the sole and extends to the toe region. Vertical sub-member 26 of the supporting member 4 has a top edge and a bottom edge which both have an upward curvature but with different central angles that define the arc length of a central region of the top edge and bottom edge curvatures. The lowest point of the top edge of supporting member 4 has a compound (or noncircular) curvature with the lowest point located below the ball region of the foot. The bottom edge of vertical sub-member 26 has an overall compound curvature that is not coextensive with the top edge of vertical sub-member 26. Relative to the lowest point of the curvature of supporting member 4, the forefoot portion of the supporting member 4 has a greater length than the rear portion of supporting member 4. The overall degree of curvature along the bottom edge of the vertical sub-member may be higher in the forefoot region than the rear portion such that the toes of a wearer's foot exhibit at least some degree of dorsal flexion when the wearer's foot is in a resting state.

Supporting member 4 may be constructed of a rigid material that still exhibits a degree of elasticity to bend when under a sufficient load. Supporting member 4 is substantially rigid to support at least some degree of dorsal flexion of the foot during the swing phase of walking or running. The supporting member may absorb the impact upon foot strike and be sufficiently compliant under a load such that the supporting member provides a positive spring force that enhances the wearer's ability to "push off" the foot from the ground. The energy return of the stiffening supporting members may be measured in a sole in accordance with ISO 17707:2005. For example, such as the embodiment shown in FIGS. 1A-1D, the supporting member may have three 3 times the energy return than the same sole without the plate.

In another embodiment, the horizontal sub-member may also have an upward curvature. In one exemplary embodiment, supporting member 4 comprises a pair of horizontal sub-members 8 with a medial horizontal sub-member 8 and lateral horizontal sub-member 8. The pair of horizontal sub-members may be integrally connected to each other or not connected and spaced away from each other. In the present embodiment, the disconnected horizontal sub-members 8 are located near the medial and lateral periphery edges of the forefoot area of midsole 6. The lowest point on the curve is substantially aligned along the ball of the foot.

The supporting member's curved region may be a circular isometric curve or a compound curve, i.e. a noncircular curve, wherein the curvature having different radii in regions along the top surface of the horizontal sub-member and/or the top edge of the vertical sub-member. The vertical sub-member of the supporting member may have a bottom edge with a curvature that is different from the curvature of the top edge of the vertical sub-member. The overall curvature of the bottom edge may have a more acute or deeper curvature that the top edge's overall curvature. Further, the bottom edge may have a greater overall curvature length than the top edge. In exemplary embodiments, the top edge has an overall curvature length that is about ninety percent to about ninety-nine percent the bottom edge's overall curvature length.

The difference in the top edge's curvature of the vertical sub-member and the bottom edge's curvature of the vertical sub-member may afford additional durability to the supporting member. In an exemplary embodiment, the vertical sub-member may have a crescent shape formed by the different curvatures of the top edge and bottom edge. The greatest height in the crescent shaped vertical sub-member may be at or near the ball of the foot with top and bottom edges converging at the ends of the vertical sub-member. The crescent shape may increase the durability of the supporting member for the vertical sub-member and the durability of any horizontal component such as a horizontal sub-member or cross bars that may be affixed to the vertical sub-member.

Figure 10A:
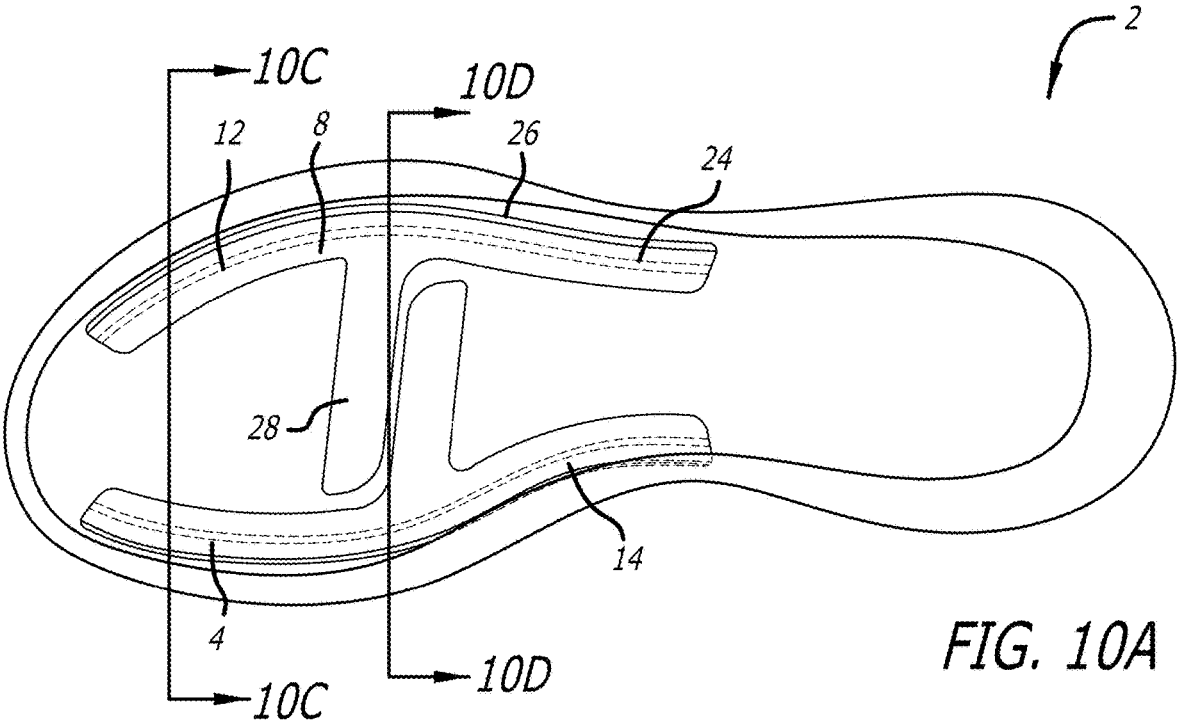
FIG. 10A is a top view of a partially assembled sole having a pair of rigid supporting members.

In exemplary embodiments of a supporting member that forms at least a portion of the midsole, the bottom edge of the vertical sub-member may have a center region comprising a first curvature that may be located at or near a location underneath the ball of the wearer's foot. The bottom edge's first curvature may extend approximately from point b to point c as shown in FIG. 10E. The bottom edge's first curvature may extend about forty percent to about sixty-five percent of the total curvature length of the bottom edge of the vertical sub-member. The bottom edge of the vertical sub-member may have an anterior region comprising a second curvature. The bottom edge's second curvature may extend approximately from point a to point b as shown in FIG. 10E. The bottom edge's second curvature may extend about fifteen percent to about thirty percent of the total curvature length of the bottom edge of the vertical sub-member. The bottom edge of the vertical sub-member may have a posterior region comprising a third curvature. The bottom edge's third curvature may extend approximately from point c to the posterior distal end as shown in FIG. 10E. The bottom edge's third curvature may extend about fifteen percent to about thirty percent of the total curvature length of the bottom edge of the vertical sub-member. The central angle $\theta_1$ that corresponds to the bottom edge's first curvature may be within a range from about 25-degrees to about 50-degrees. The central angle $\theta_2$ that corresponds to the bottom edge's second curvature may be within a range from about 5-degrees to about 15-degrees. The bottom edge's third curvature may be substantially linear or have a concave downward configuration with a corresponding downward central angle. The bottom edge's compound curvature may further comprise a plurality of additional curvatures and/or linear portions along the anterior and/or posterior portion of the vertical sub-member.

Further to this embodiment, the top edge of the vertical sub-member may have a center region comprising a first curvature that may be located at or near a location underneath the ball of the wearer's foot. The top edge's first curvature may extend approximately from point x to point y as shown in FIG. 10F. The top edge's first curvature may extend about forty percent to about sixty-five percent of the total curvature length of the top edge of the vertical sub-member. The top edge of the vertical sub-member may have an anterior region comprising a second curvature. The top edge's second curvature may extend approximately from point w to point x as shown in FIG. 10F. The top edge's second curvature may extend about ten percent to about thirty percent of the total length of the top edge of the vertical sub-member. The top edge of the vertical sub-member may have a posterior region comprising a third curvature. The top edge's third curvature may extend approximately from point y to the posterior distal end as shown in FIG. 10F. The top edge's third curvature may extend about fifteen percent to about thirty percent of the total curvature length of the top edge of the vertical sub-member. The central angle $\theta_4$ that corresponds to the top edge's first curvature may include a value within a range from about 15-degrees to about 40-degrees. The central angle $\theta_5$ that corresponds to the top edge's second curvature may be within a range from about 5-degrees to about 15-degrees. The top edge's third curvature may be substantially linear or have a concave downward configuration with a corresponding downward central angle. The top edge's compound curvature may further comprise a plurality of additional curvatures and/or linear portions along the anterior and/or posterior portion of the vertical sub-member.

In some embodiments, the bottom edge of a vertical sub-member may have at least one degree of curvature that corresponds to a smaller isometric circle than at least one top edge degree of curvature of a vertical sub-member. In exemplary embodiments, the supporting member is proportioned to have a central angle $\theta_1$ associated with the bottom edge's first curvature that is about 1.1 to 2.0 times greater than the corresponding central angle $\theta_4$ associated with the top edge's first curvature. In one example, the central angle $\theta_1$ associated with the bottom edge's first curvature is about 38-degrees and the corresponding central angle $\theta_4$ associated with the top edge's first curvature is about 27-degrees. The fold difference in at least the bottom and top edge's first curvature angles may give rise to a crescent shaped or partially crescent shaped vertical sub-member that may exhibit a greater durability than a plate having a flat/planar structure.

The vertical sub-member may have a maximum height that will increase the durability of the supporting member and may be as high as the vertical height of the sole. The height of the vertical sub-member may vary along the longitudinal axis of the supporting member or may be constant. In exemplary embodiments where a supporting member extends from the midfoot to the forefoot and is a component within the midsole, the vertical sub-member may have a greatest height located at a central region of the supporting member and is configured to gradually decrease in height in the anterior and posterior directions to have the least height at an anterior portion and a posterior portion of the supporting member. In some configurations, the height of the vertical sub-member ranges from about 0.3 mm to about 10.0 mm when the supporting member is incorporated within the midsole. The range of height may proportionately be adjusted for smaller or larger sized footwear. In some cases, the height may be greater than 10 mm for larger sizes or thicker soles. In one example, the height of a vertical sub-member is about 6.0 mm at a location at or near the ball of the foot and decreases to about 1.0 mm at the anterior and posterior distal ends.

In exemplary embodiments of a supporting member that forms at least a portion of the outsole, the bottom edge of the vertical sub-member may comprise a compound curvature including an anterior portion and a posterior portion. The bottom edge's anterior portion may comprise a first curvature that may extend about eighty percent to about ninety percent of the total curvature length of the bottom edge of the vertical sub-member, extending approximately from point e to point f as shown in FIG. 12C. The bottom edge's posterior portion may comprise a second curvature that may extend about ten percent to about twenty percent of the total curvature length of the bottom edge of the vertical sub-member, extending approximately from point f to point g as shown in FIG. 12C. The central angle $\theta_7$ that corresponds to the bottom edge's first curvature may be within a range from about 35-degrees to about 45-degrees. The bottom edge's second curvature may be substantially linear or has a central angle $\theta_8$. The bottom edge's compound curvature may further comprise a plurality of additional curvatures and/or linear portions along the anterior and/or on the posterior portion of the vertical sub-member.

Further to this embodiment, the top edge of the vertical sub-member may comprise a compound curvature that has an overall curvature which is more shallow or obtuse than the bottom edge's overall curvature or may be substantially linear. The top edge's posterior portion may comprise a first curvature that may extend approximately from point s to point t as shown in FIG. 12D. The top edge's anterior portion may comprise a second curvature that may extend approximately from point q to point r as shown in FIG. 12D. The top edge may have a central region comprising a third curvature that may extend approximately from r to points as shown in FIG. 12D. The top edge's first curvature may have an upward concave configuration and have an associated central angle $\theta_9$ or may be substantially linear. The top edge's second curvature may have an upward concave configuration and have an associated central angle $\theta_{10}$ or may be substantially linear. The top edge's third curvature may have a downward concave configuration and have an associated downward central angle. The top edge's compound curvature may further comprise a plurality of additional curvatures and/or linear portions along the anterior and/or on the posterior portion of the vertical sub-member.

In an alternate exemplary embodiment of a supporting member that forms at least a portion of the outsole, the bottom edge of the vertical sub-member may have a center region comprising a first curvature that may be located at or near a location underneath the ball of the wearer's foot. The bottom edge's first curvature may extend about thirty percent to about forty percent of the total curvature length of the bottom edge of the vertical sub-member. The bottom edge of the vertical sub-member may have an anterior region comprising a second curvature. The bottom edge's second curvature may extend about ten percent to about twenty percent of the total curvature length of the bottom edge of the vertical sub-member. The bottom edge of the vertical sub-member may have a posterior region comprising a third curvature. The bottom edge's third curvature may extend about forty percent to about fifty percent of the total curvature length of the bottom edge of the vertical sub-member. The central angle that corresponds to the bottom edge's first curvature may be within a range from about 10-degrees to about 20-degrees. The central angle that corresponds to the bottom edge's second curvature may be within a range from about 5-degrees to about 15-degrees. The central angle that corresponds to the bottom edge's third curvature may be within a range from about 5-degrees to about 15-degrees. The bottom edge's compound curvature may further comprise a plurality of additional curvatures and/or linear portions along the anterior and/or posterior portion of the vertical sub-member.

Further to this embodiment, the top edge of the vertical sub-member may have a center region comprising a first curvature that may be located at or near a location underneath the ball of the wearer's foot. The top edge's first curvature may extend about forty percent to about fifty percent of the total curvature length of the top edge of the vertical sub-member. The top edge of the vertical sub-member may have an anterior region comprising a second curvature. The top edge's second curvature may extend about five percent to about ten percent of the total curvature length of the top edge of the vertical sub-member. The top edge of the vertical sub-member may have a posterior region comprising a third curvature. The top edge's third curvature may extend about thirty percent to about forty percent of the total curvature length of the top edge of the vertical sub-member. The central angle that corresponds to the top edge's first curvature may be within a range from about 10-degrees to about 20-degrees. The central angle that corresponds to the top edge's second curvature may be within a range from about 1-degree to about 5-degrees. The central angle that corresponds to the top edge's third curvature may be within a range from about 5-degrees to about 15-degrees. The top edge's compound curvature may further comprise a plurality of additional curvatures and/or linear portions along the anterior and/or posterior portion of the vertical sub-member.

Further to this exemplary embodiment, the supporting member is proportioned to have a central angle associated with the bottom edge's first curvature that is about 0.5 to about 1.5 times the corresponding central angle associated with the top edge's first curvature. In one example, the central angle associated with the bottom edge's first curvature is about 18-degrees and the corresponding central angle associated with the top edge's first curvature is about 19-degrees.

In exemplary embodiments of a supporting member that forms at least a portion of the outsole, the bottom edge of the vertical sub-member may be curved along the longitudinal axis of the sole, corresponding to the curvatures of the forefoot and midfoot regions of the sole. The top edge of the vertical sub-member may have a plurality of curvatures and/or linear sections. Further, the supporting member is configured to have the height taper at an anterior portion and at a posterior portion of the supporting member. In some configurations, the top edge of the vertical sub-member tapers down to meet the bottom edge of the vertical sub-member. In other configurations, the top edge of the vertical sub-member tapers down and the bottom edge of the vertical sub-member tapers up to have the top edge and bottom edge meet at a midpoint. In one example, the height is about 13.5 mm at a location at or near the ball of the foot and decreases to about 0.6 mm at the anterior end and to about 2.7 mm at the posterior end. In another example, the height is about 10.7 mm at the posterior portion of the supporting member and decreases to about 2.8 mm at the anterior end and to about 3.4 mm at the posterior end. The heights may proportionately be adjusted for smaller or larger sized footwear.

Figure 2A:
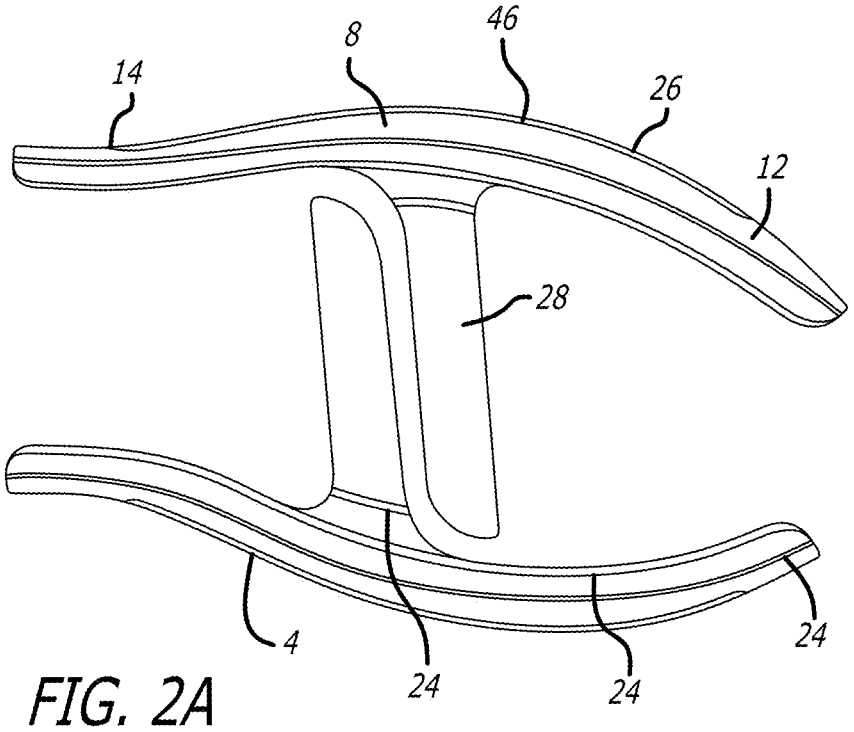
FIG. 2A is a top perspective view of a supporting member.
Figure 2B:
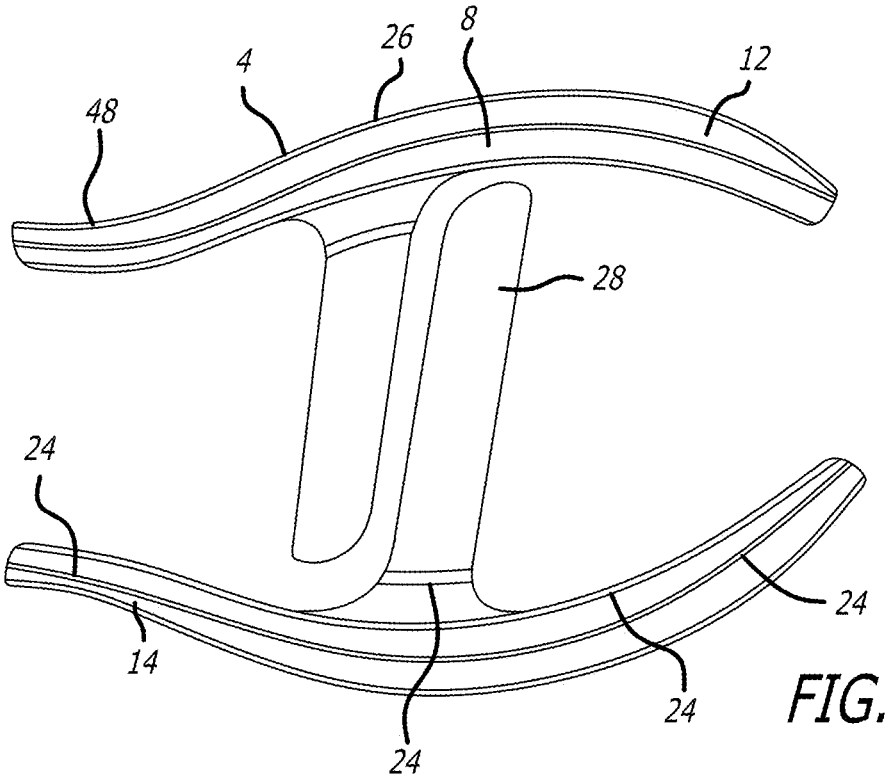
FIG. 2B is a bottom view of the supporting member shown in FIG. 2A.
Figure 2C:
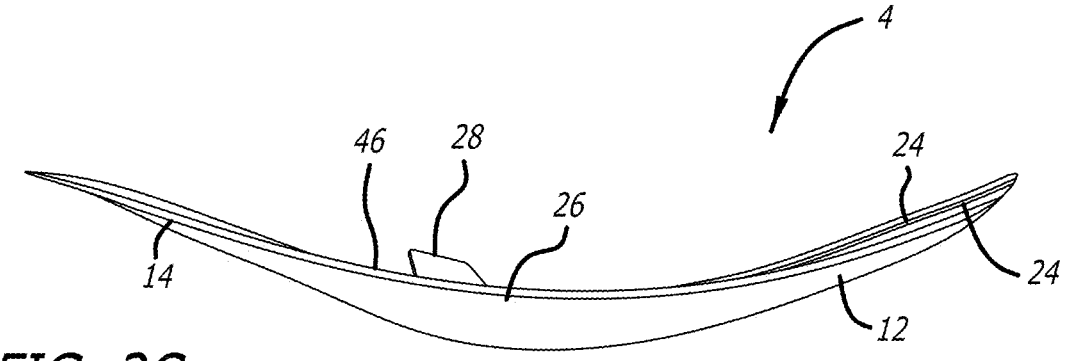
FIG. 2C is a right side view of the medial supporting member shown in FIG. 2A.
Figure 2D:
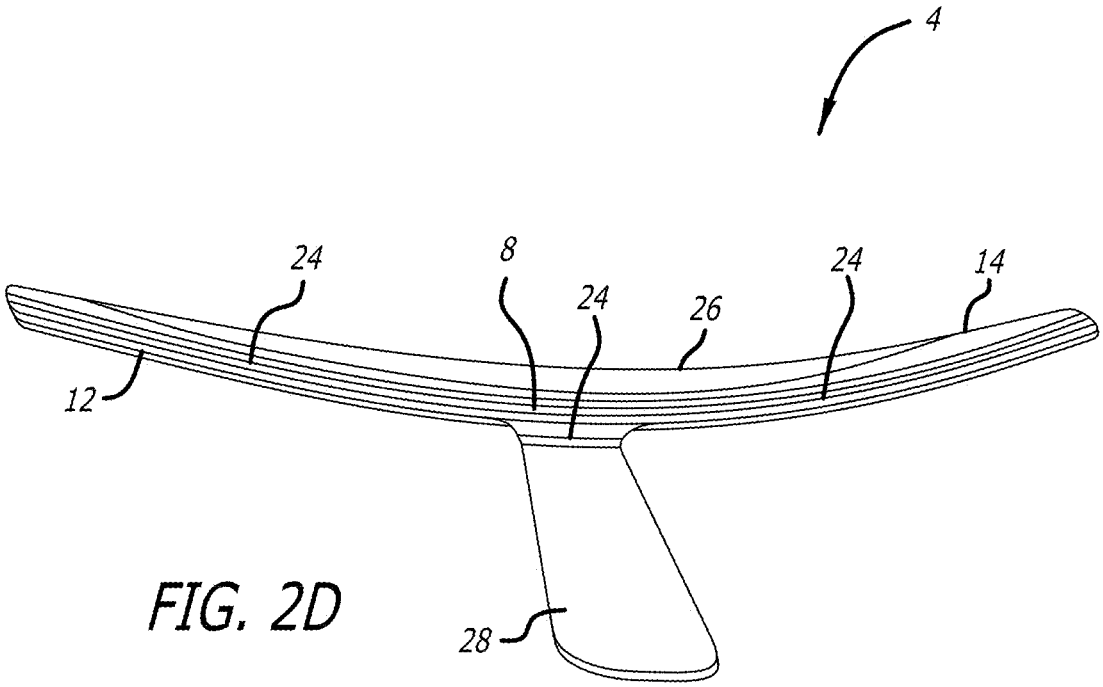
FIG. 2D is a left side view of the medial supporting member shown in FIG. 2A.
Figure 2E:
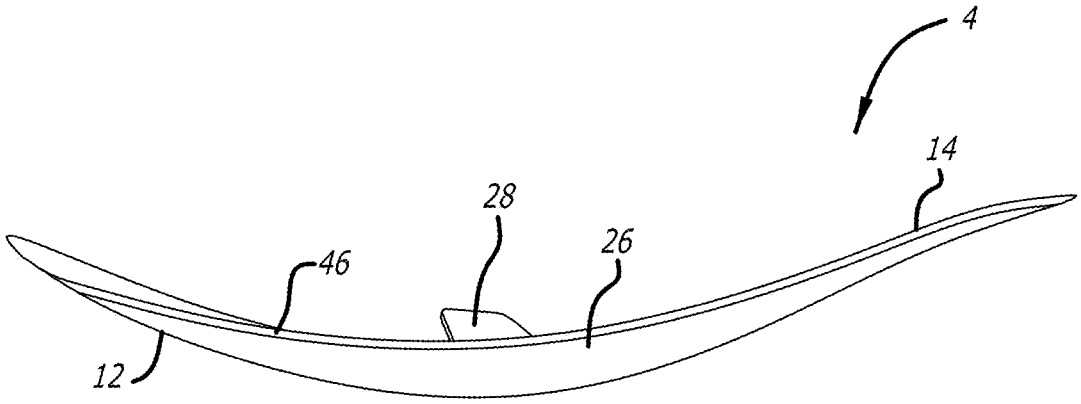
FIG. 2E is left side view of the lateral supporting member shown in FIG. 2A.
Figure 2F:
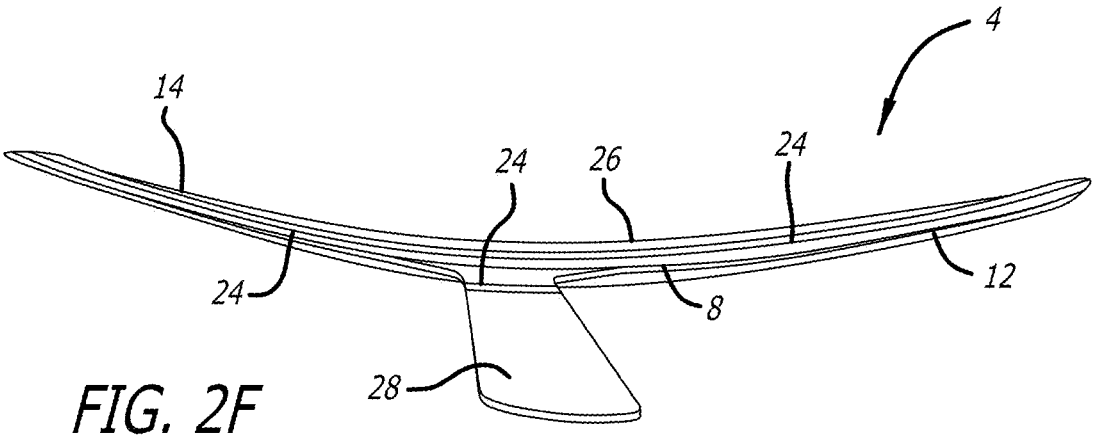
FIG. 2F is a right side view of the lateral supporting members shown in FIG. 2A.

In a preferred embodiment such as FIGS. 2E & 2F, the anterior portion 12 of the supporting member 4 is configured to be curved upward toward the toes. The posterior portion 14 is curved upward towards the midfoot region. The posterior end 14 of the supporting member 4 may plateau or become more leveled than the supporting member's 4 curved region. A portion of the distal end of the posterior portion 14 of the horizontal sub-member 8 may also further extend beyond the vertical sub-member 26 and plateau near and/or under the midfoot region.

In an exemplary embodiment of a supporting member with one or more horizontal sub-members, the width and length of the horizontal sub-members may be uniform or vary at different regions. The horizontal sub-members' width may be the widest at the lowest point of the curved region of the horizontal sub-member and thinner at other regions. The horizontal sub-members may have the least width at the anterior distal end and posterior distal end. The width may also taper from the lowest point of the supporting member to the anterior distal end and posterior distal end. The medial and lateral horizontal sub-members may be coextensive with each other or one of the horizontal sub-members may extend along the longitudinal length of the sole more than the other horizontal sub-member when one side of the sole requires additional support more than the other side.

The one or more horizontal sub-members may be curved along the lateral axis of the sole. The lateral curvatures may correspond to the curvatures of the periphery of the midsole. The curved configuration may also be defined by the desired support of the wearer's foot such as an upward concave curvature. In an exemplary embodiment, the horizontal sub-member's curvature may be at least partially coextensive with the vertical sub-member's curvature wherein the coextensive region is defined by the two points where the vertical sub-member's top edges join with the bottom edges. The curvature may be more pronounced in areas in the sole that correspond to the forefoot and less pronounced in regions that correspond to the midfoot.

Support ridges of the supporting member. The curved supporting member may have one or more support ridges above and/or below the top and lower surfaces of the supporting member that extends along the longitudinal length of the supporting member. An example of a support ridge 24 is shown in FIG. 2D. The ridges may add increased rigidity to the supporting member. The ridges may also increase the elasticity of the supporting member under a sufficient load. Furthermore, the ridges may improve the durability of the supporting member by reducing wear and cracking from extended use. Ridges may extend along any portion of a supporting member. In one exemplary embodiment, at least one ridge may extend a portion of the longitudinal length of the horizontal sub-member. A ridge may also extend the cross bar along the longitudinal direction of the sole that extends from the heel to the toe.

Features of Exemplary Embodiments. Further to the exemplary supporting member of FIGS. 1A-1D, supporting member may have a portion that is exposed on the exterior of midsole 6. The exposed portion may include a vertical sub-member 26 that extends upward against the exterior midsole's vertical surface or at least partially embedded into the sidewalls of the midsole.

Vertical sub-members may also enhance or solely provide the enhanced stiffness to reduce or prevent flexion of the sole and increase durability to the supporting member. See for example FIGS. 15A-15D. Further to this embodiment, the vertical sub-members may also reduce mediolateral shifting of the sole caused by mediolateral shear forces exhibited upon the shoe during use. In FIGS. 1A-1D, supporting member 4 may have a vertical sub-member 26 that is integrally connected to a horizontal sub-member 8 which is approximately perpendicular to vertical sub-member 26 of supporting member 4 and extends parallel to the exterior surface of the midsole 6. That is, the vertical sub-member and horizontal sub-member of the supporting member form substantially an "L-shape" structure. For example, see FIG. 10D. A vertical sub-member may be at a distinct acute or obtuse angle relative to the approximately horizontal plane of the horizontal sub-members. A vertical sub-member may also be embedded within the midsole.

The height of the vertical sub-member component may vary along the longitudinal axis of the supporting member or be of a uniform height. In the exemplary embodiment of FIGS. 1A-1D, vertical sub-members 26 have the greatest height at the lowest point of the curved supporting member 4. The horizontal sub-member may be connected to the vertical sub-member at the bottom edge of the vertical sub-member or at any location along the height of the vertical sub-member. In one exemplary embodiment, the vertical sub-member may be connected to the horizontal sub-member of the supporting member in a location between the bottom edge and top edge of the vertical sub-member. The vertical sub-member may taper at either the anterior and/or posterior ends of the supporting member. The vertical sub-member's thickness may also be uniform or vary. The vertical sub-member's thickness may be thickest at the lowest point of the curvature of the supporting member and thinner near the anterior and posterior ends of the supporting member. The vertical sub-member's thickness may also vary along the height of the vertical sub-member. In one exemplary embodiment, the area near the bottom edge of the vertical sub-member may be thicker and the area near the top edge of the vertical sub-member may be thinner. An exemplary embodiment comprises a portion of the height of the vertical sub-member to be at least 3 times the latitudinal thickness.

The vertical sub-member may alone provide the necessary curvature to enhance running economy or in combination with other sub-elements. See for example FIG. 15A-15D. The vertical sub-member 26 has at least one curvature along the longitudinal axis of the sole. The upward curvature of the vertical sub-member may provide the desired rigidity to reduce flexion and compliance for energy to a cushioning element of a sole.

Cross bar of the supporting member. In some preferred embodiments, the supporting member may have one or more horizontal sub-members, and each horizontal sub-member may have a cross bar that extends in the mediolateral direction of the supporting member further than the horizontal sub-member. In the exemplary embodiment of FIGS. 1A-1D, the location of cross bars 28 may be positioned in an area located under the region at or near the ball of the foot. Cross bar 28 is an elongated structure with a flat top and a flat opposite facing bottom surface. The cross bar may enhance the rigidity while not extending fully across a plane of the sole. By limiting the amount of material in the supporting member by using a cross bar that does not fully extend beyond the joint region at or near the ball of the foot, the mass of the shoe is reduced which in turn enhances the economy of the activity of the wearer.

In one exemplary embodiment, a single cross bar may extend between two or more horizontal sub-members of the supporting member. The cross bar may extend in an area at or near the ball of the foot. The cross bar may be connected to the horizontal sub-member or directly to the vertical sub-member. The cross bar may act as a flange that provides increased rigidity in localized areas of the cushioning element and/or aid in securing the supporting member to the sole. In other embodiments, a cross bar may extend between at least a pair of horizontal sub-members and integrally connected to the horizontal sub-members or not connected to each other. In other embodiments, the cross bars may be connected through a connecting member. The connecting member may be constructed of rigid material or flexible material. In the exemplary embodiment as shown in FIGS. 1A-1D, first cross bar 28 extends across the sole in a first mediolateral direction from lateral horizontal sub-member 8. Second cross bar 28 extends across the sole in a second mediolateral direction from medial horizontal sub-member 8. First cross bar 28 is also spaced away from second cross bar 28. The first cross bar may also be connected by a connecting member. The connecting member may be rigid or flexible.

In FIGS. 1A-1D, cross bars 28 and horizontal sub-members 8 of supporting members 4 have a surface that is adjacent and affixed to a second layer 38 of sole 2. A first layer 36 of sole 2 may be bonded to second layer 38 thereby locating at least a portion of supporting members 4 within midsole 6 between sole layers 36, 38. Portions of sole 2 may be at least partially located around the supporting members 4.

Figure 2G:
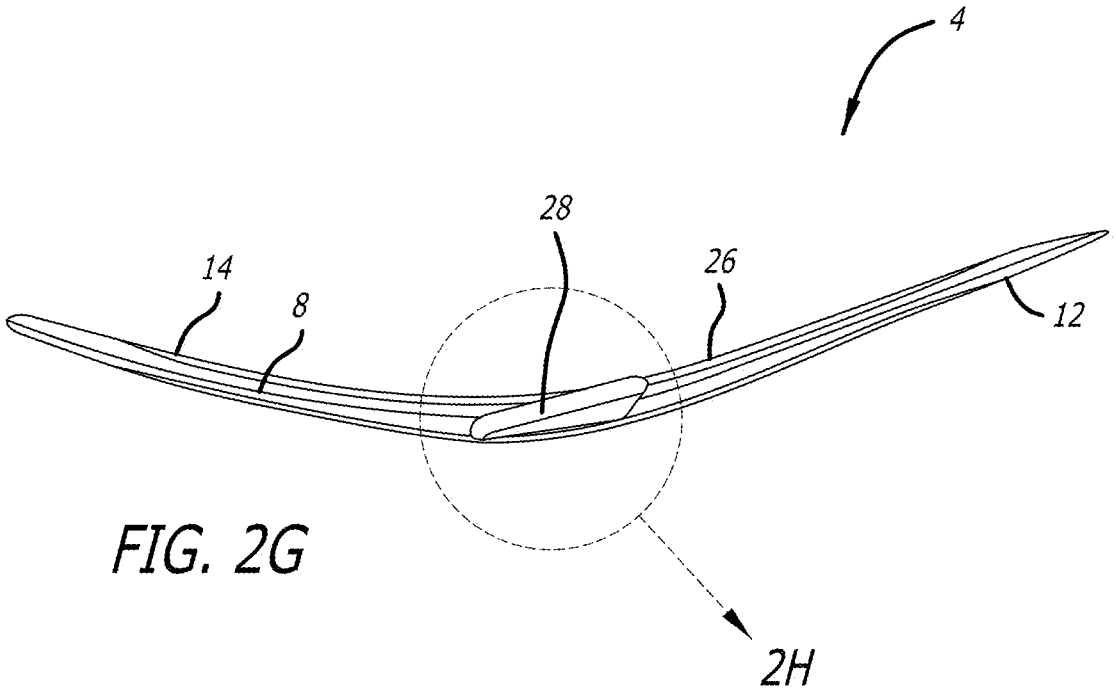
FIG. 2G is a perspective side view of the medial supporting member shown in FIG. 2A
Figure 2H:
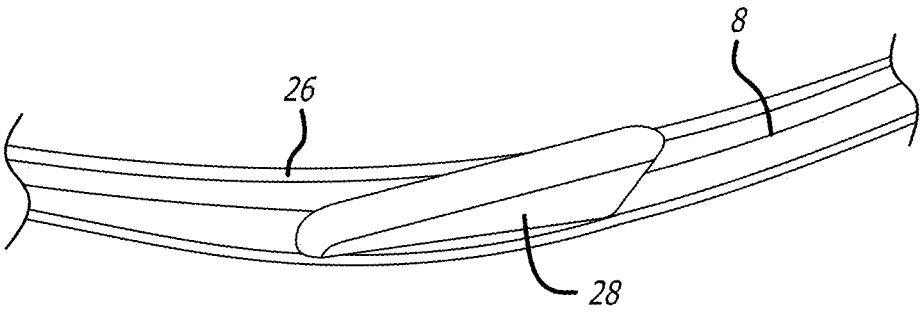
FIG. 2H is a magnified perspective side view of a portion of the medial supporting member shown in FIG. 2G.
Figure 3A:
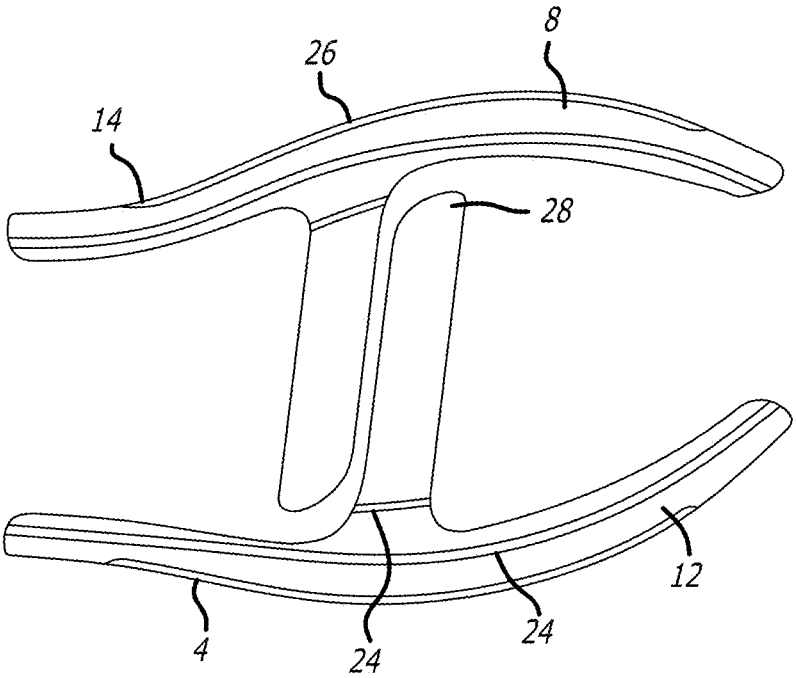
FIG. 3A is a top view of a supporting member.
Figure 3B:
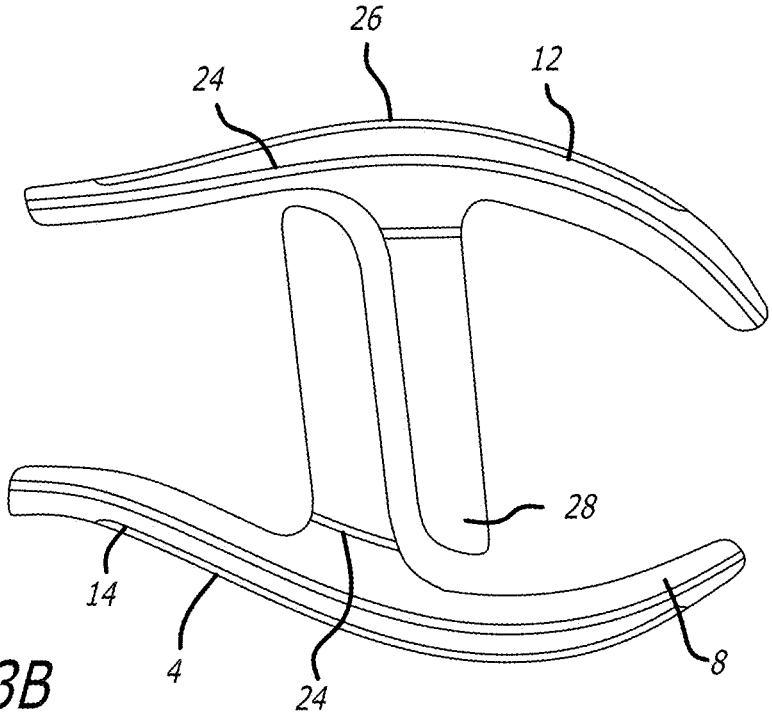
FIG. 3B is a bottom view of the supporting member in FIG. 3A.
Figure 3C:
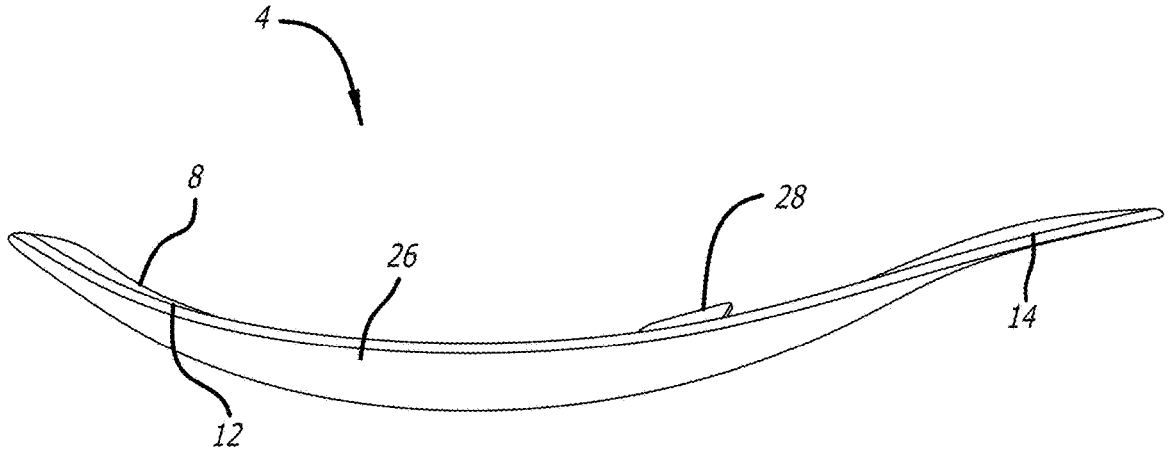
FIG. 3C is a left side view of the medial supporting member shown in FIG. 3A.
Figure 3D:
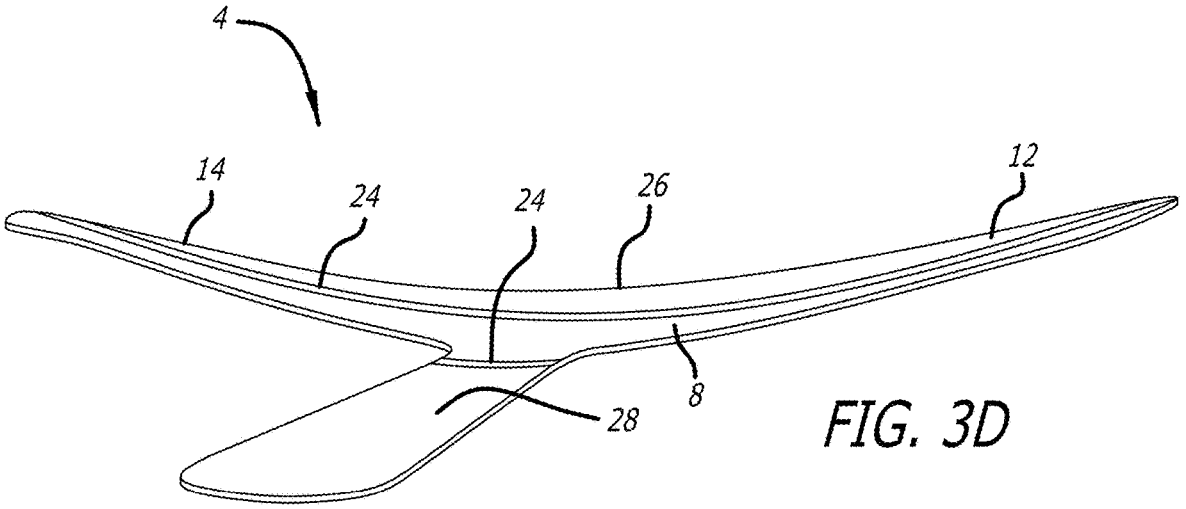
FIG. 3D is a right side view of the medial supporting member shown in FIG. 3A.
Figure 3E:
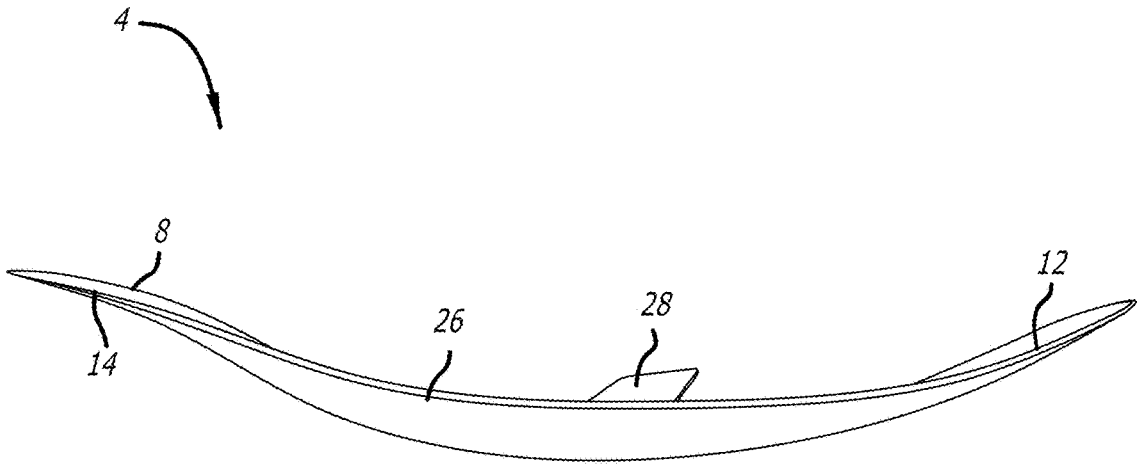
FIG. 3E is a right side view of the lateral supporting member shown in FIG. 3A.
Figure 3F:
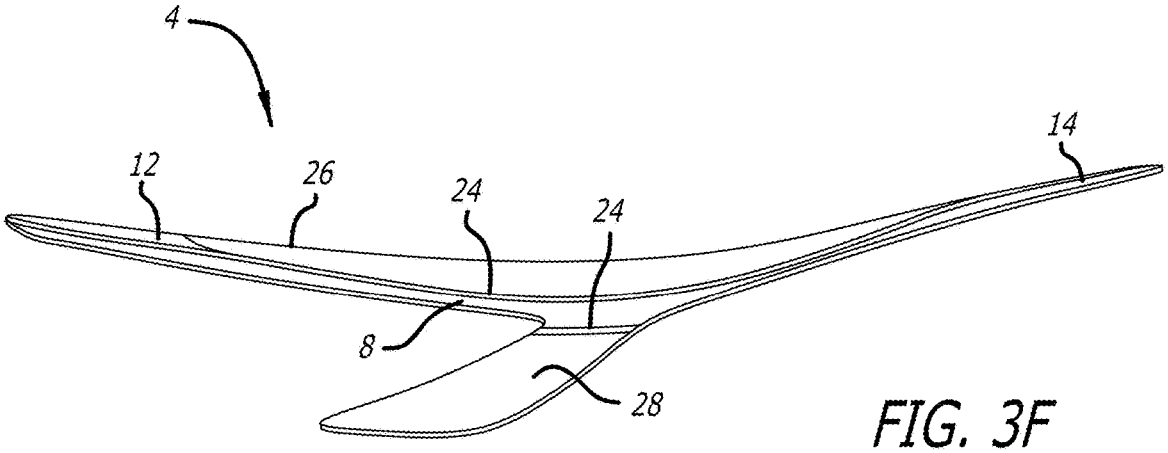
FIG. 3F is a left side view of the lateral supporting member shown in FIG. 3A.
Figure 4A:
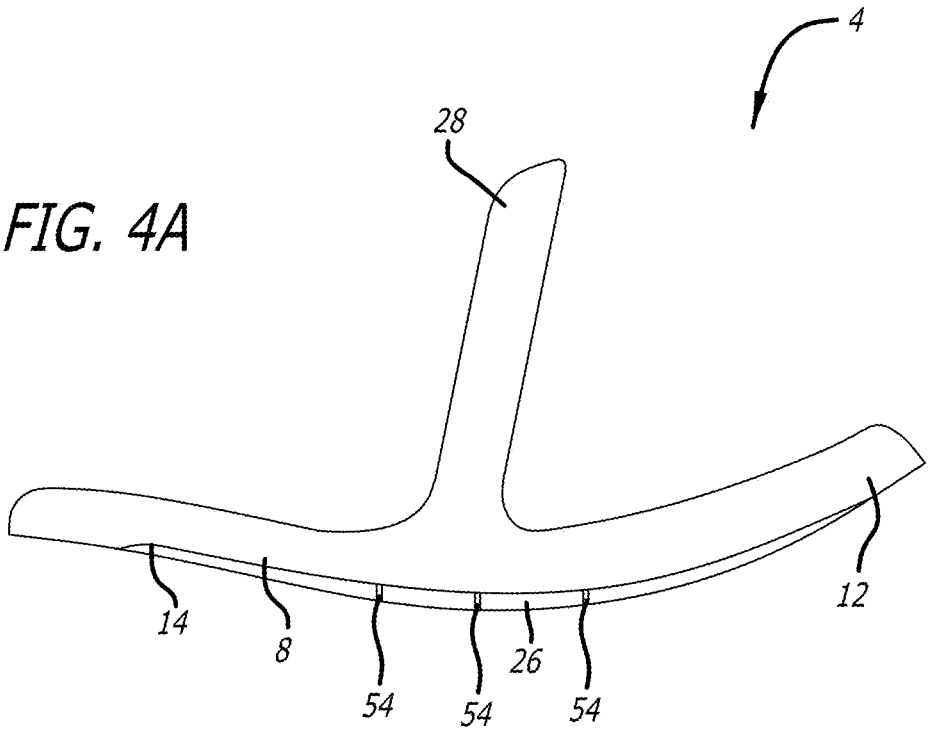
FIG. 4A is a top view of a lateral supporting member.
Figure 4B:
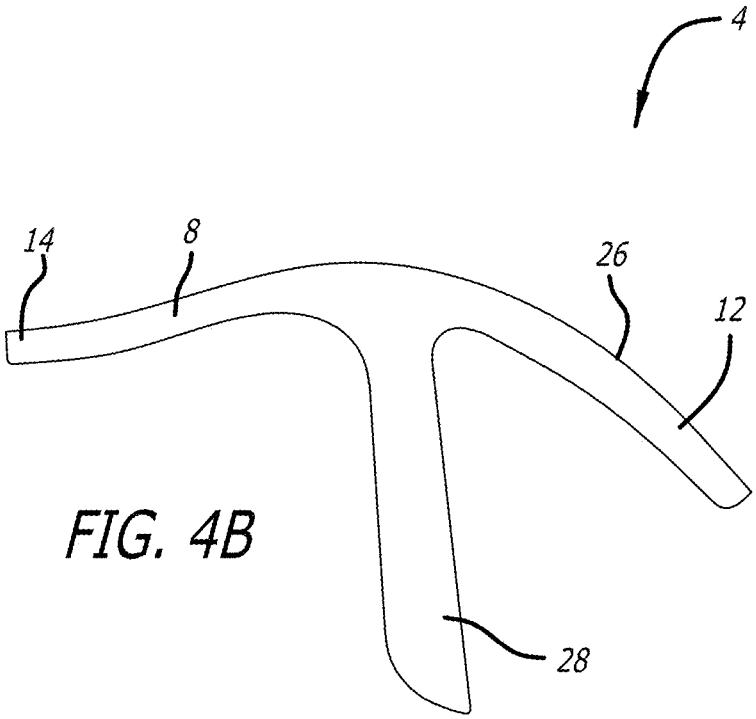
FIG. 4B is a bottom view of the lateral supporting member shown in FIG. 4A.
Figure 4C:
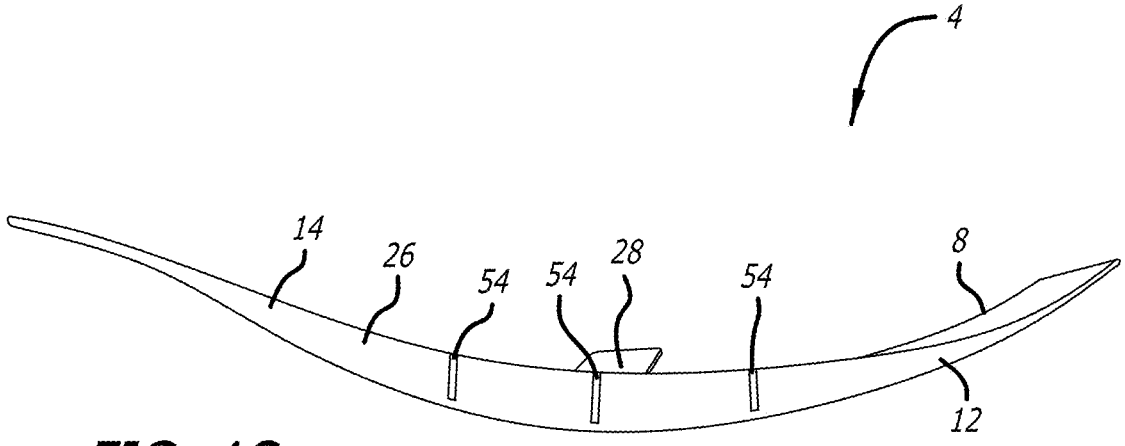
FIG. 4C is a right side view of the lateral supporting member shown in FIG. 4A.
Figure 4D:
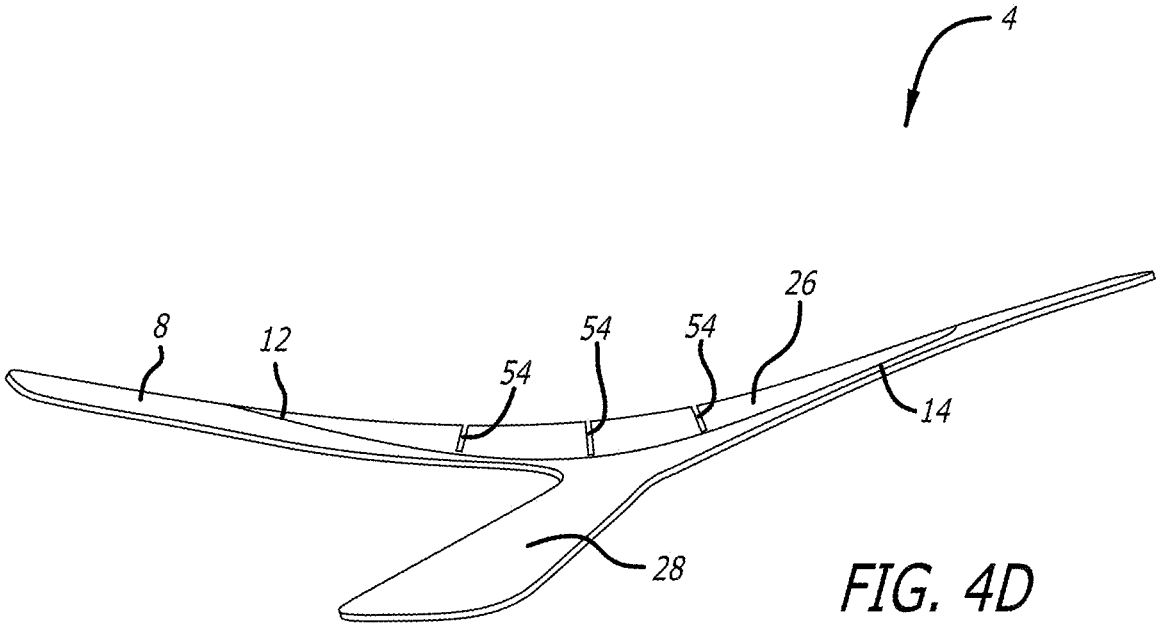
FIG. 4D is a left side view of the lateral supporting member shown in FIG. 4A.
Figure 5A:
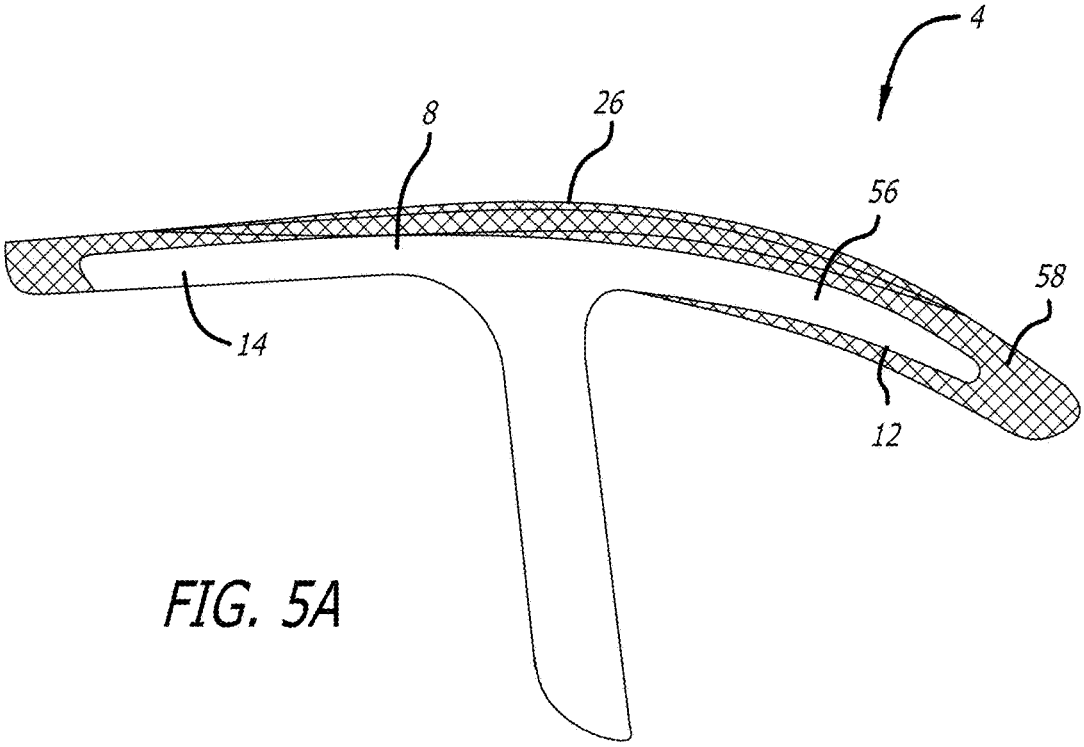
FIG. 5A is a top view of a lateral supporting member.
Figure 5B:
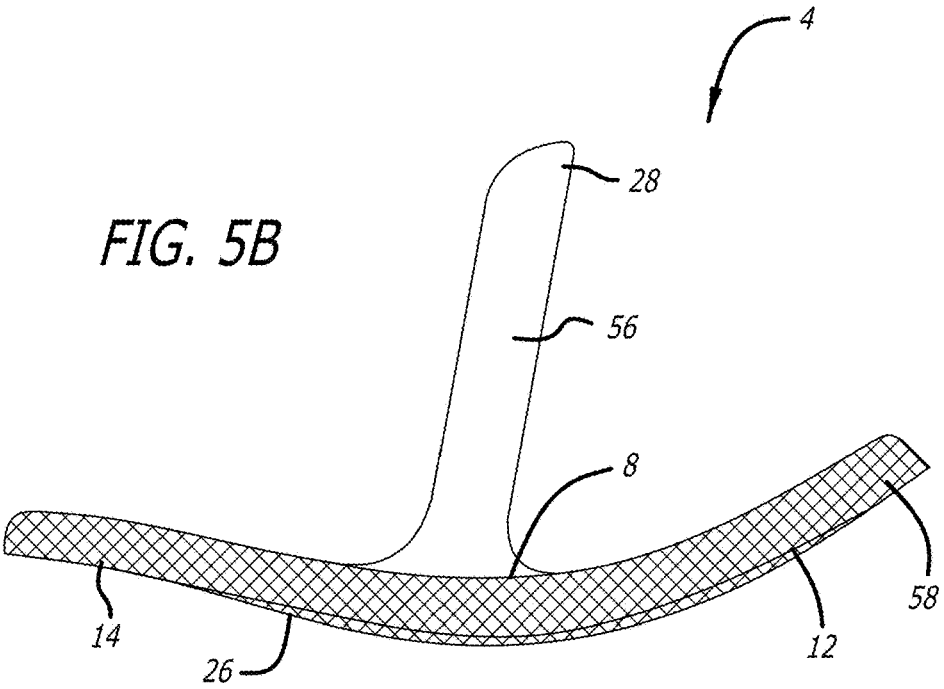
FIG. 5B is a bottom view of the lateral supporting member shown in FIG. 5A.
Figure 5C:
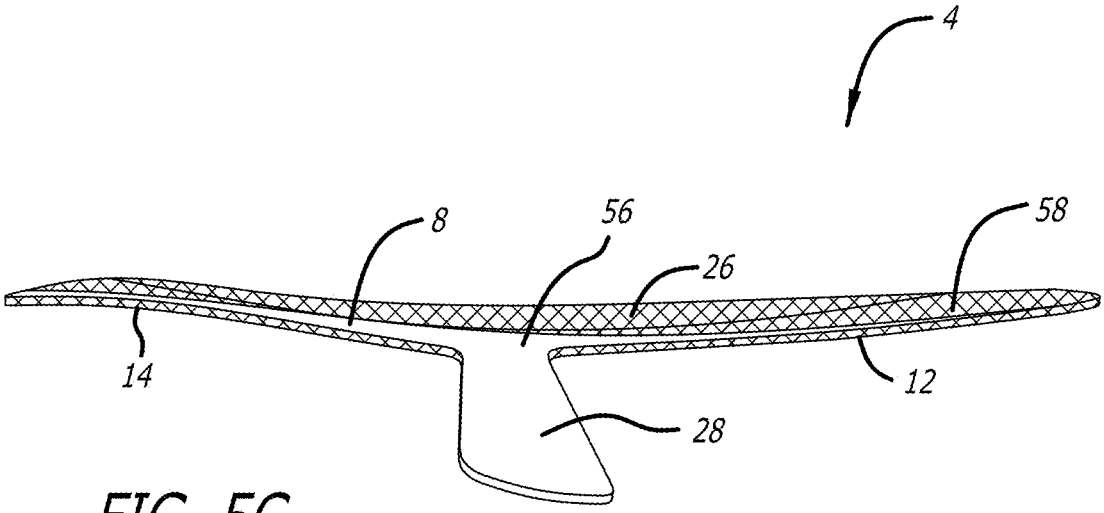
FIG. 5C is a right side view of the lateral supporting member shown in FIG. 5A.
Figure 5D:
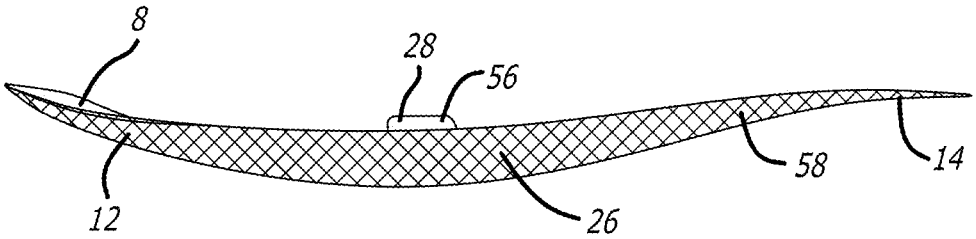
FIG. 5D is a left side view of the lateral supporting member shown in FIG. 5A.

A cross bar may also have one or more ridges to provide increased rigidity and elasticity. FIGS. 2A-2D& 2F show ridges 24 that extend across horizontal sub-members 8, and ridges 24 that extend the longitudinal direction of cross bars 28. The ridges avoid constructing thicker supporting members that would add mass to the sole and reduce running economy. The cross bar may have a flat surface that is planar with the central plateaued portion of a horizontal sub-member. The flat surface of the cross bar may also be askew from the plane of the central plateaued portion of the horizontal sub-member as shown in FIGS. 2G and 2H. The flat surface of the cross bar may have a curvature or twisted orientation at some portions from the plane of the central plateaued portion of the horizontal sub-member.

The cross bar may be constructed of the same material as the horizontal sub-members or may be constructed of different materials. The material forming the cross bar may be more flexible than the material forming the horizontal sub-members. In an alternate embodiment, the cross bars may have a construction that exhibits greater flexibility. Cross bars with greater flexibility than the horizontal sub-members reduce the possible cracking of the horizontal sub-members caused from use in running.

Cushioning Material of the Sole. The sole may be constructed of any lightweight material to enhance running economy. In an exemplary embodiment, the sole is constructed of supercritical fluid (SCF) foamed materials, such as the sole described in U.S. patent application Ser. No. 16/675,086 filed Nov. 5, 2019, which is hereby incorporated by reference in its entirety. The use of SCFs in foaming processes has been known to improve impact strength and toughness of the resulting foam products. Such foams may provide for both savings on material and weight reduction. Examples of materials for the SCF foam materials include, but are not limited to, ethylene vinyl acetate (EVA), polyolefins, thermoplastic elastomers, or any combination thereof. Examples of solvents that may be used when combining the processing of polymer materials with SCF to create a low density foamed material include carbon dioxide ($CO_2$), nitrogen ($N_2$), ethylene, ethane, nitrous oxide, butane, propane, ammonia, acetone, methanol, ethanol, tetrahydrofuran (THF), toluene, and water. In some exemplary embodiments, the sole may comprise two or more materials, where a SCF-expanded polymer material may be used in one area of the sole and non-SCF-expanded material is used at another location. In some embodiments, the sole is comprised only of non-SCF-expanded materials. In preferred embodiments, any suitable materials that compress resiliently under applied loads may be used.

Figure 14A:
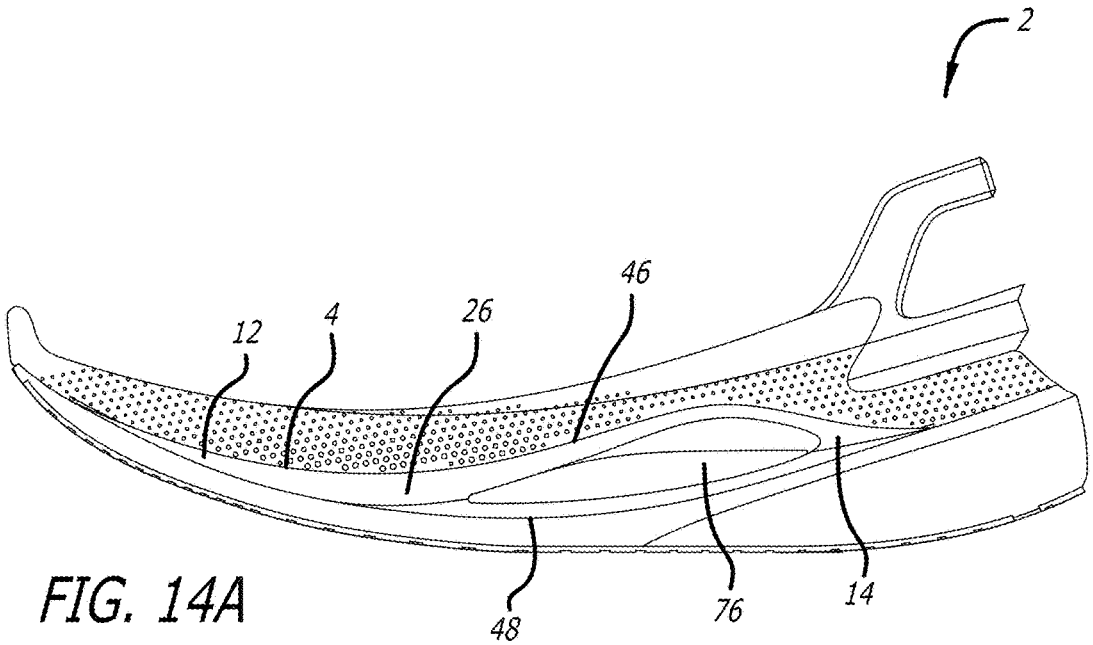
FIG. 14A is a medial side view of a sole having a pair of rigid supporting members.
Figure 14B:
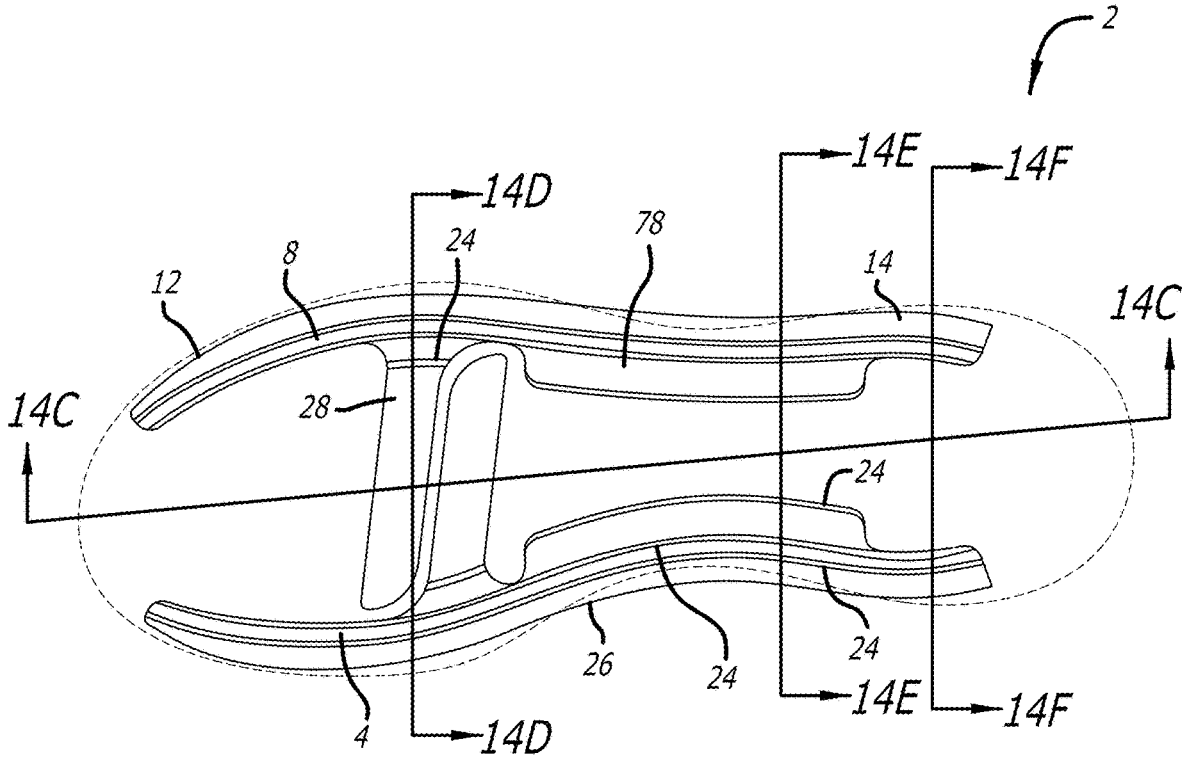
FIG. 14B is a top view of the partially assembled sole shown in FIG. 14A.
Figure 14E:
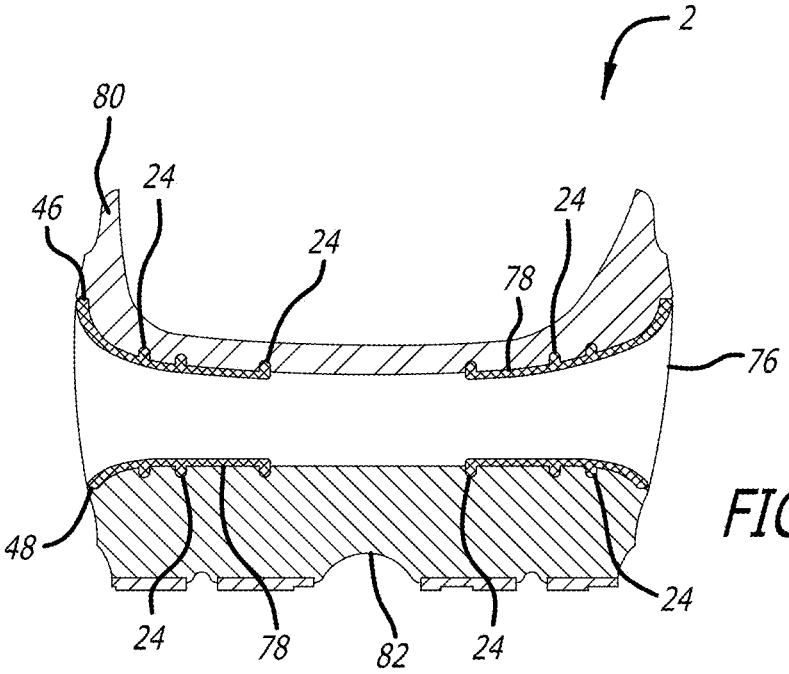
FIG. 14E is a cross-sectional view of the sole shown in FIG. 14A, as defined by section line 14E-14E in FIG. 14B.
Figure 14F:
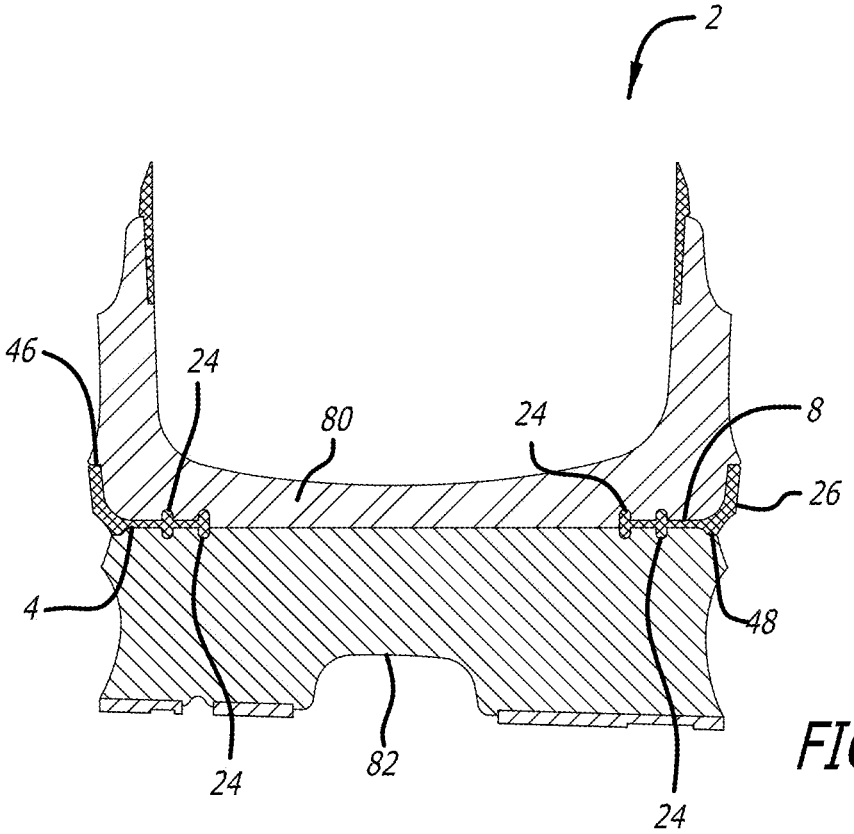
FIG. 14F is a cross-sectional view of the sole shown in FIG. 14A, as defined by section line 14F-14F in FIG. 14B.

Apertures in the Supporting Member. The supporting member may include one or more apertures or perforations. An example embodiment of aperture 76 in supporting member 4 is shown in FIG. 14A. The apertures or perforations may add increased flexibility to the supporting member and/or reduce the weight of the supporting member which in turn enhances running economy. The apertures or perforations may be incorporated in a vertical sub-member, a horizontal sub-member, a cross bar, or any component of a supporting member in which incorporation of an aperture or perforation will increase running economy. The apertures or perforations may be of consistent size or vary in size. Further, the apertures or perforations may be distributed uniformly along the supporting member or incorporated at one or more particular locations.

Features in exemplary embodiments. With respect to the exemplary embodiment of FIGS. 2A-2H, anterior portion 12 of horizontal sub-members 8 of supporting member 4 is configured to be curved upward toward the toes. Posterior portion 14 of horizontal sub-members 8 is curved upward towards the midfoot region. Horizontal sub-members 8 each have posterior distal ends that plateau at the midfoot as shown in FIGS. 2C-2F.

As shown in FIGS. 2A and 2C, the width of horizontal sub-members 8 is greatest at the lowest region of the upward curvature and tapers at the distal ends. Horizontal sub-members 8 are curved along the lateral axis of the sole, corresponding to the curvatures of the perimeter of a midsole. Anterior portion 12 and posterior portion 14 of horizontal sub-members 8 are curved inward as shown in FIGS. 2A and 2B. The curvature of horizontal sub-members 8 are coextensive with the perimeter of the midsole.

Horizontal sub-members 8 of supporting members 4 of the preferred embodiment are each integrally connected to vertical sub-member 26 which are configured to be at least partially coextensive with vertical sub-member 26. Vertical sub-members 26 are comprised of top edge 46 and bottom edge 48. Horizontal sub-members 8 connect at a location between top edge 46 and to bottom edge 48 of vertical sub-members 26. Vertical sub-members 26 are at an approximately right angle with the latitudinal curved plane of horizontal sub-members 8. Vertical sub-members 26 have a height that is measured as the distance from bottom edge 48 to top edge 46. The height is greatest near the center portion of vertical sub-members 26 and tapers towards the anterior and posterior distal ends. Horizontal sub-members 8 may extend beyond the posterior and anterior distal ends of vertical sub-members 26 as shown in FIGS. 2A & 2D-2G.

Vertical sub-members 26 have a latitudinal thickness, otherwise referred to as the width of vertical sub-member 26. The latitudinal thickness of vertical sub-members 26 taper at their respective anterior and posterior distal ends. The area near the base of vertical sub-members 26 may be thicker than the upper portion of vertical sub-members 26. Furthermore, at least a portion of vertical sub-member 26 has a height that is greater than a latitudinal thickness of vertical sub-members 26.

Curved horizontal sub-members 8 are integrally connected to a cross bar 28. Cross bars 28 are configured to have substantially flat surfaces. The latitudinal plane of the distal end of the cross bar 28 is askew from the adjacent latitudinal plane of horizontal sub-member 8 which is located at the lowest point of the upward curvature of supporting member 4. Cross bar 28 is positioned such that the top portion of vertical sub-member 26 extends above cross bar 28 and that the bottom portion of vertical sub-member 26 extends below cross bar 28 as shown in FIGS. 2G and 2H. The top portion of vertical sub-member 26 extends above cross bar 28 a greater distance than the distance that the bottom portion of vertical sub-member extends below cross bar 28.

With reference to FIG. 2A, a first cross bar 28 extends across the sole in a first mediolateral direction from a lateral horizontal sub-member 8. A second cross bar 28 extends across the sole in a second mediolateral direction from a medial horizontal sub-member 8. Cross bars 28 are positioned in an area located under the region of the ball of the foot. A first cross bar 28 is spaced away from a second cross bar 28 such that the cross bars 28 span a greater area of a region at or near the ball of the foot. The first cross bar may be located closer to the toe area of the sole and the second cross bar may be located closer to the heel area. The cross bars 28 are aligned along the same mediolateral axis while being spaced away from each other.

Further to the exemplary supporting members of FIGS. 2A-2H, supporting members 4 have a plurality of support ridges 24 on the top surface and lower surface of the supporting members 4 that extend along the longitudinal length of the supporting members 4. Some of ridges 24 extend the full length of the top and bottom surfaces of horizontal sub-members 8. Other ridges 24 extend across the top and bottom surfaces of cross bars 28.

In another exemplary embodiment, a pair of supporting members 4 are shown in FIGS. 3A-3F. Exemplary materials may include a rigid elastomer infused with carbon fiber. Less ridges 24 may also be used when increased durability may be afforded by the material used in the supporting member. Further to this embodiment, the bottom portion of vertical sub-members 26 do not extend below their respective integrally connected horizontal sub-members 8 and cross bars 28.

In another exemplary embodiment of FIGS. 4A-4D, supporting member 4 has horizontal sub-member 8 which does not have support ridges 24 on the top or bottom surface of horizontal sub-member 8. Further to this embodiment, a top portion of vertical sub-member 26 extends above cross bar 28 and a bottom portion of vertical sub-member 26 does not extend below cross bar 28. Furthermore, vertical sub-member 26 has a plurality of sipes 54 that extend from a top portion of vertical sub-member 26 and in a downward direction. Further to this embodiment, horizontal sub-member 8 extends a greater distance in the anterior and posterior longitudinal directions than vertical sub-member 26 so that the posterior and anterior distal ends are not directly adjacent to vertical sub-member 26.

In another exemplary embodiment, supporting member 4 is composed of a first material 56 and a second material 58 that partially coats the first material 56 as shown in FIGS. 5A-5D. In other embodiments, the second material may also fully coat the first material. The first material 56 is composed of a more rigid material such as a carbon fiber-based material while the second material 58 is a more flexible material such as TPE.

In another embodiment, a first material may form a portion of the supporting member while a second material or possibly other materials forms other portions of the supporting member. In an additional embodiment, the second material may coat the first material forming a vertical sub-member having sipes or apertures located in the first material. The second material may also cover or fill the space within the one or more sipes.

Figure 6A:
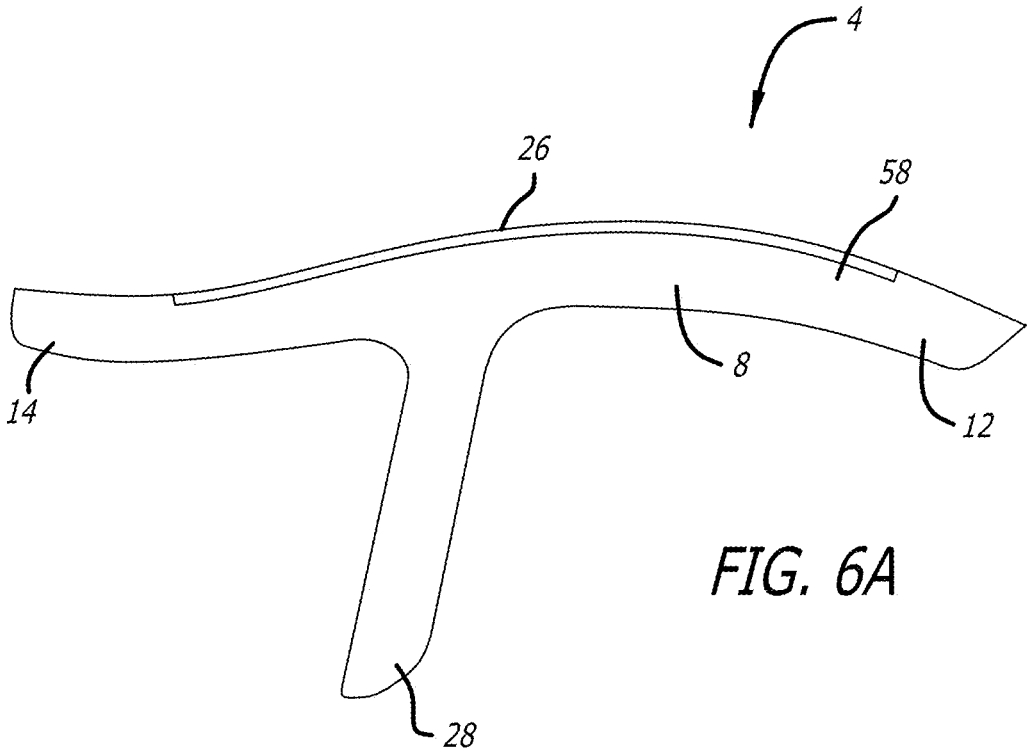
FIG. 6A is a top view of a medial supporting member.
Figure 6B:
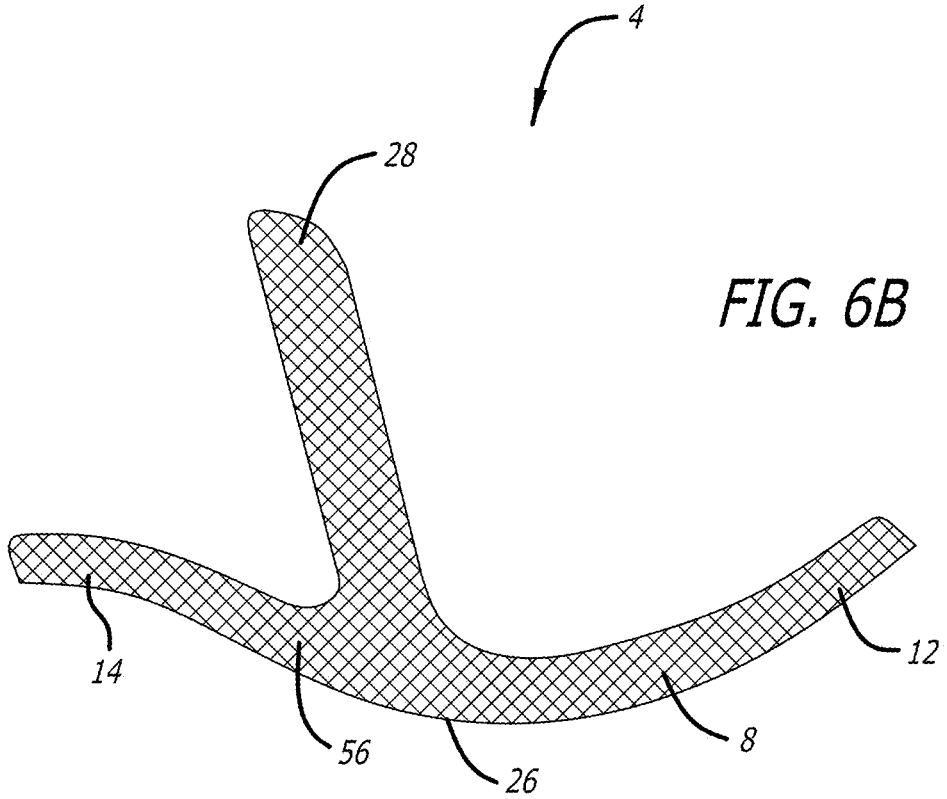
FIG. 6B is bottom view of the medial supporting member shown in FIG. 6A.
Figure 6C:
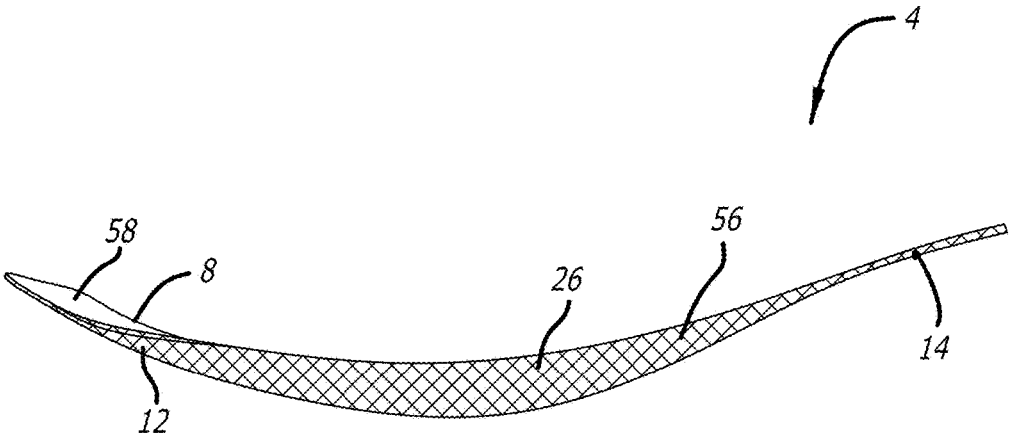
FIG. 6C is left side view of the medial supporting member shown in FIG. 6A.

FIGS. 6A-6C show another embodiment of supporting member 4 in which bottom surface of horizontal sub-member 8, bottom surface of cross bar 28, and an exterior facing surface of vertical sub-member 26 is first material 56. A top surface of horizontal sub-member 8, a top surface of cross bar 28, and an interior facing surface of vertical sub-member 26 is formed by second material 58. The first material may be a more rigid material than the second material.

Figure 7A:
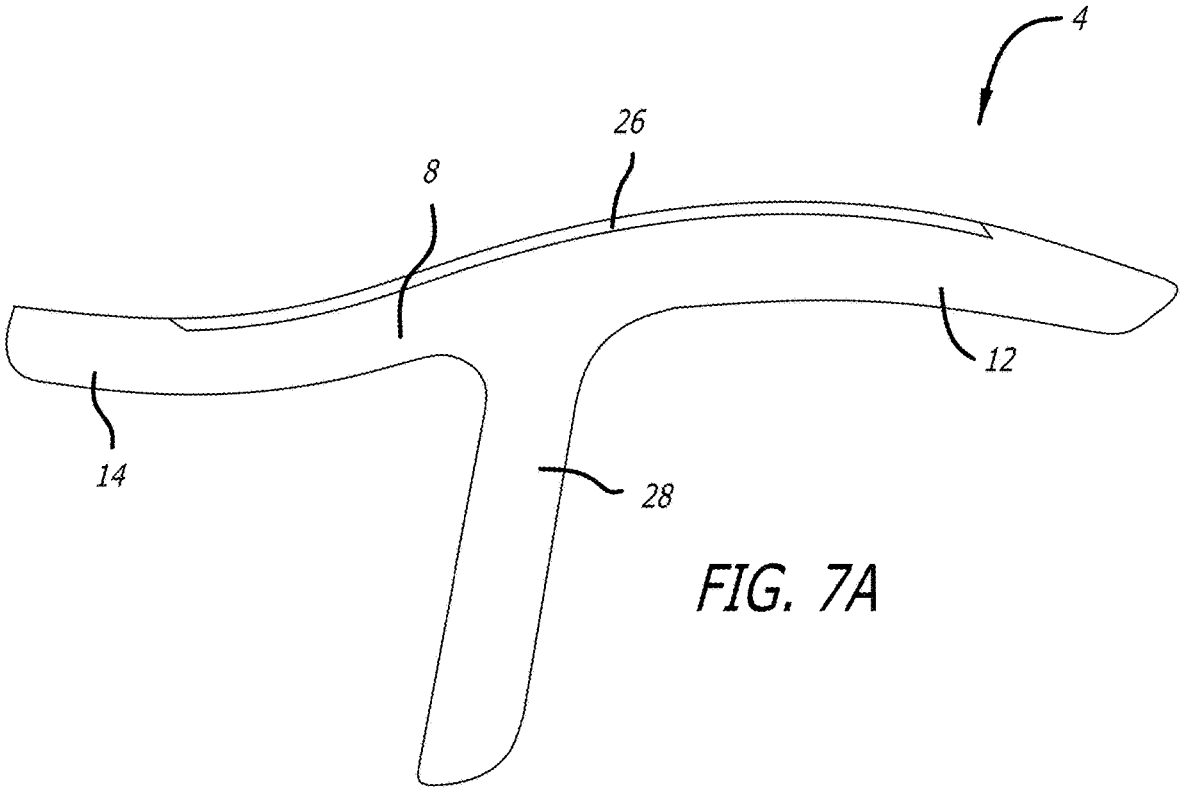
FIG. 7A is a top view of a medial supporting member.
Figure 7B:
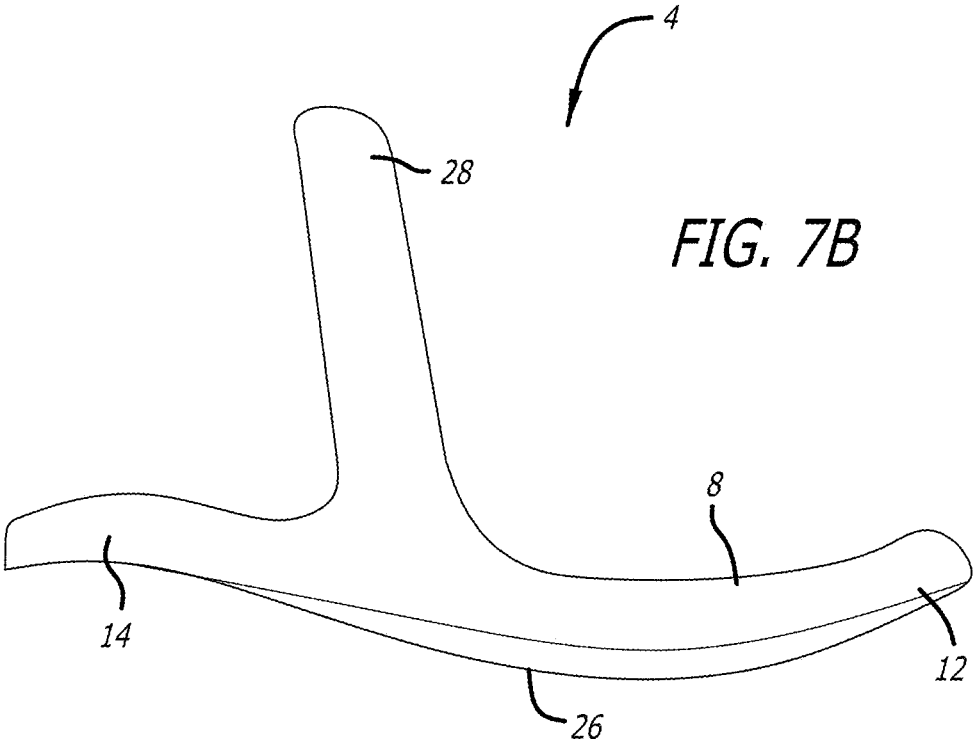
FIG. 7B is a bottom view of the medial supporting member shown in FIG. 7A.
Figure 7C:
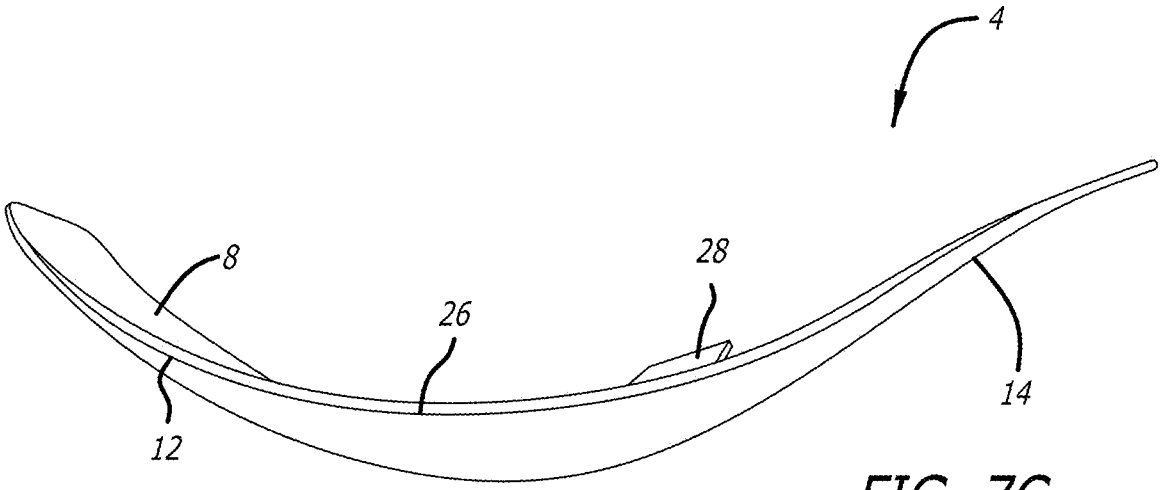
FIG. 7C is a left side view of the medial supporting member shown in FIG. 7A.
Figure 8C:
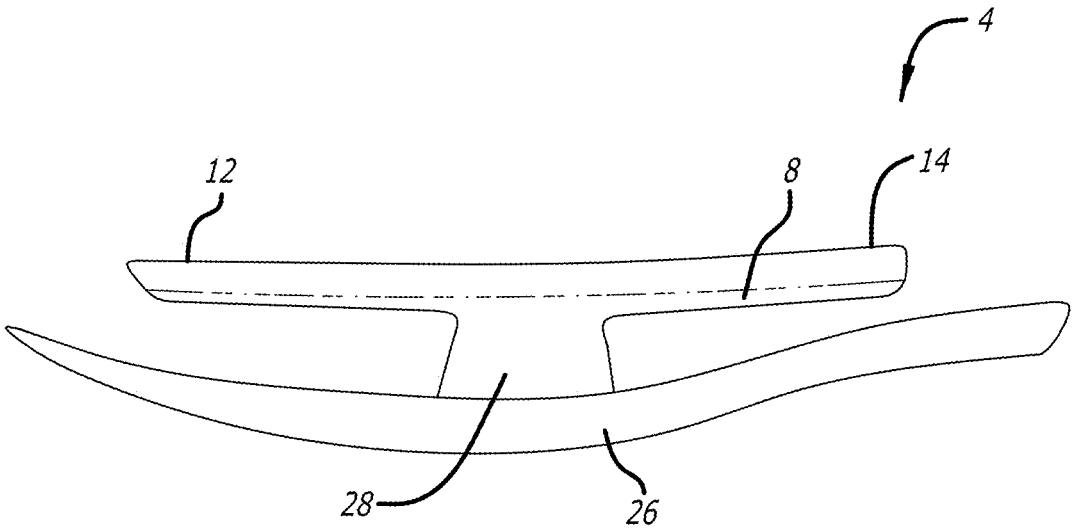
FIG. 8C is a left side view of the supporting member shown in FIG. 8A.
Figure 8D:
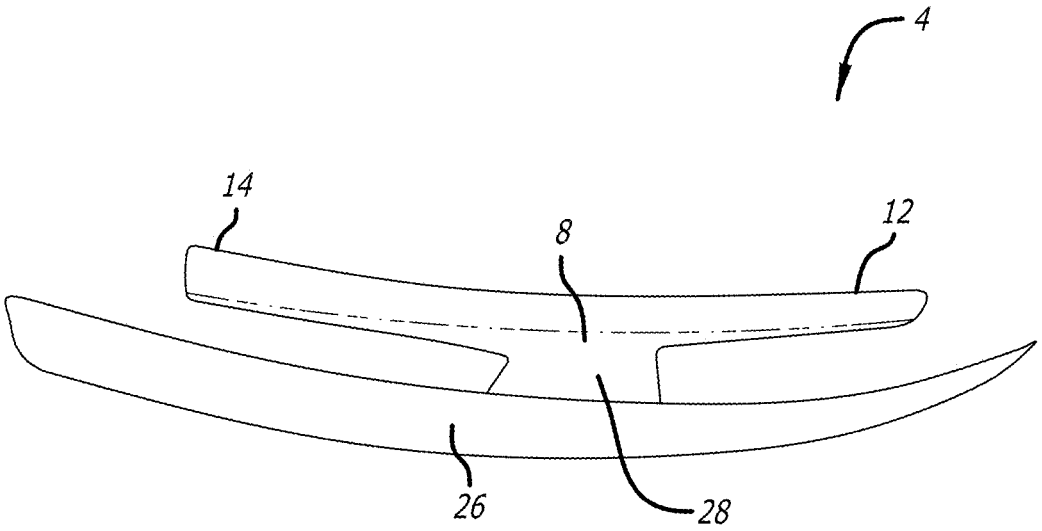
FIG. 8D is a right side view of the supporting member shown in FIG. 8A.
Figure 9A:
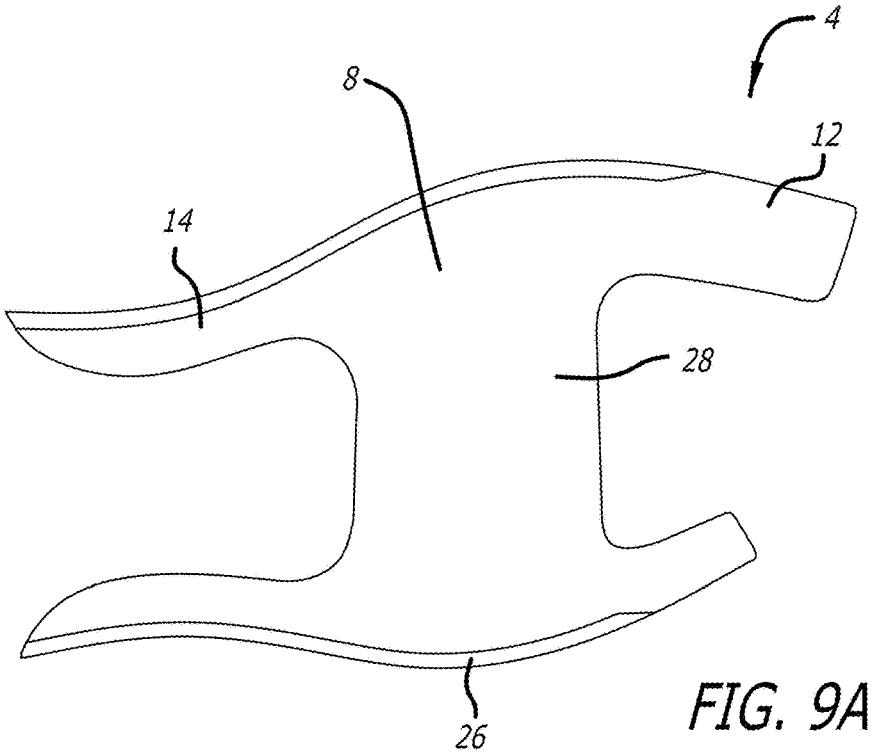
FIG. 9A is a top view of a supporting member.
Figure 9B:
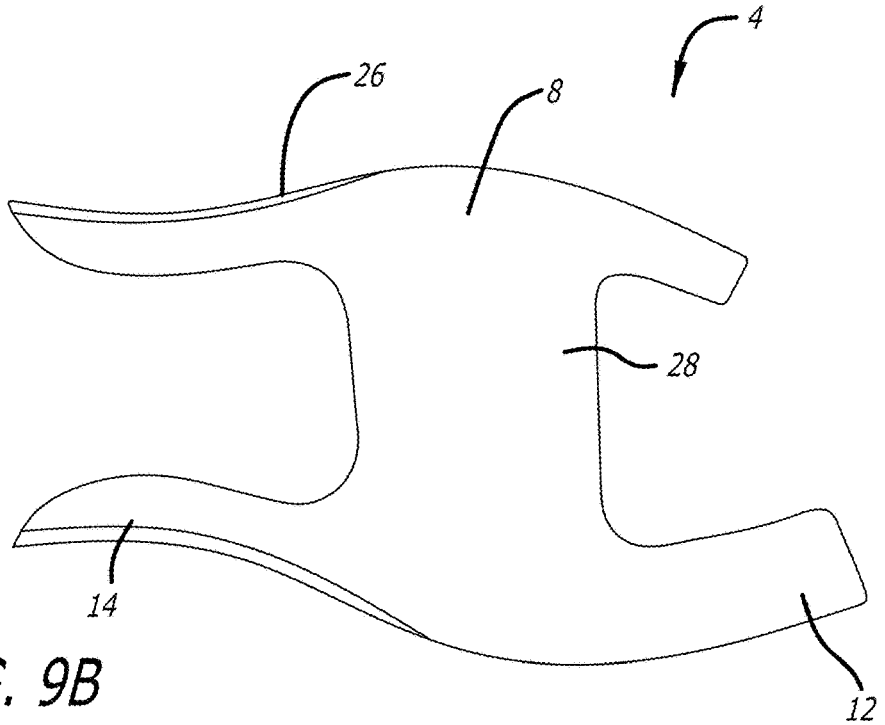
FIG. 9B is a bottom view of the supporting member shown in FIG. 9A.
Figure 9C:
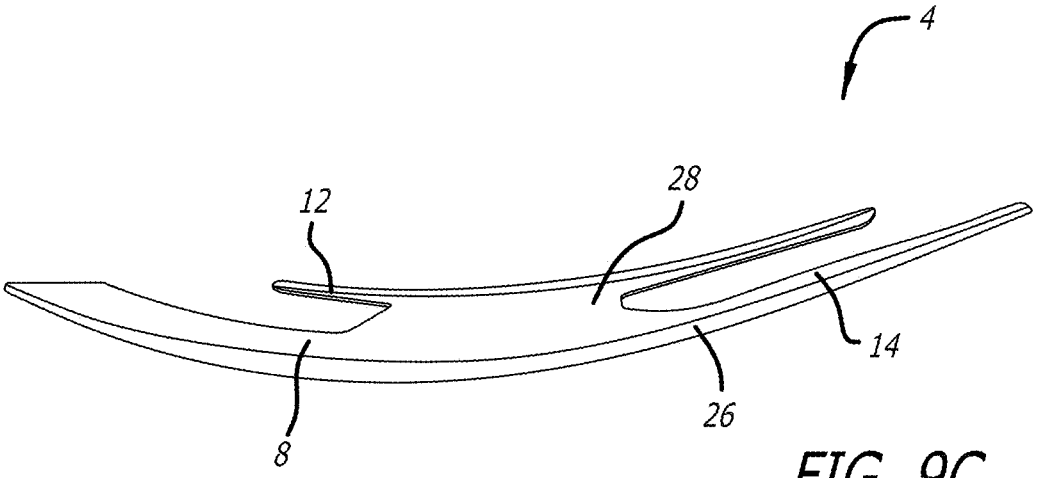
FIG. 9C is a left side view of the supporting member shown in FIG. 9A.
Figure 9D:
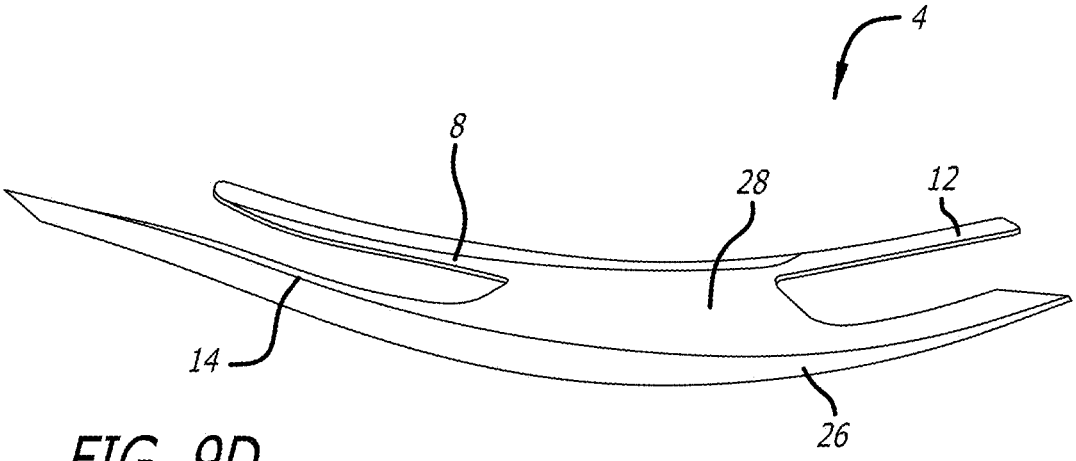
FIG. 9D is a right side view of the supporting member shown in FIG. 9A.
Figure 10B:
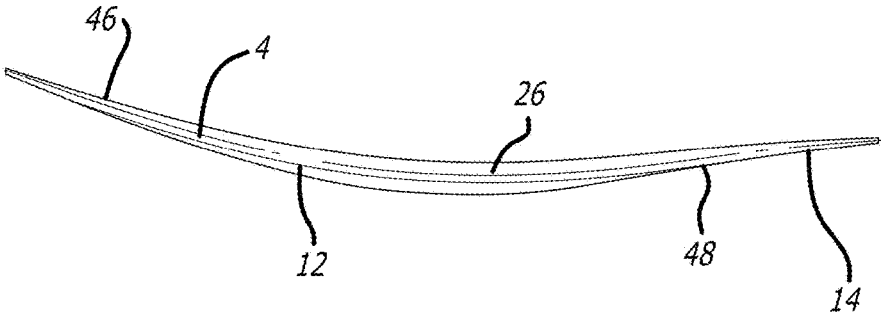
FIG. 10B is a side view of the medial supporting member shown in FIG. 10A.

In another exemplary embodiment as shown in FIGS. 7A-7C, supporting member 4 has anterior portion 12 that is configured to have a greater degree of curvature upward toward the toes, and posterior portion 14 that is configured to have a greater degree of curvature upward towards the midfoot region, than the embodiment shown in FIG. 10B. The top edge of vertical sub-member 26 has at least a portion of the curvature that is less shallow than at least a portion of the curvature of the bottom edge of vertical sub-member 26. The height of the vertical sub-member measured at the lowest region of its curvature may be more than the embodiment shown in FIG. 10B.

In another exemplary embodiment, supporting member 4, as shown in FIGS. 8A-8D, has medial and lateral horizontal sub-members 8 which are connected by a single cross bar 28. Cross bar 28 is located near the lowest point of the curvature of supporting member 4. Further to this embodiment, horizontal sub-members 8 are centrally planar and curve upward towards anterior portions 12, posterior portions 14, and vertical sub-members 26. The connection between vertical sub-member 26 and horizontal sub-members 8 are curved upward to form rounded edges along the longitudinal axis of supporting member 4.

In yet another embodiment as shown in FIGS. 9A-9D, supporting member 4 has a pair of horizontal sub-members 8 that are connected by a single cross bar 28. Cross bar 28 has an upward curvature that is coextensive with a portion of the horizontal sub-members 8. Further to this embodiment, medial anterior portion 12 of medial horizontal sub-member 8 is wider than lateral anterior portion 12 of lateral horizontal sub-member 8. Still further to this embodiment, lateral anterior portion 12 of lateral horizontal sub-member 8 is shorter than medial anterior portion 12 of medial horizontal sub-member 8. Further to this embodiment, vertical sub-member 26 has a greater height along posterior portions 14 than along anterior portions 12.

Figure 10C:
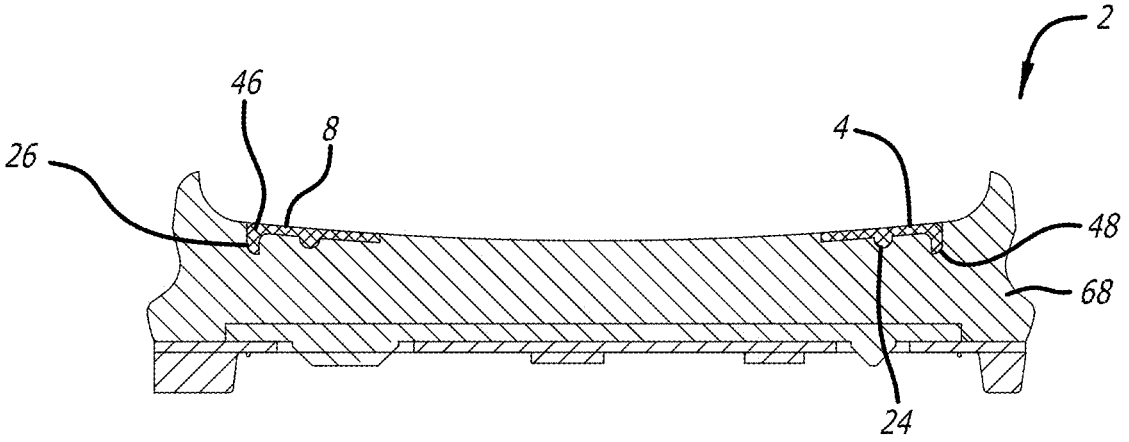
FIG. 10C is a cross-sectional view of the sole shown in FIG. 10A, as defined by section line 10C-10C in FIG. 10A.
Figure 10D:
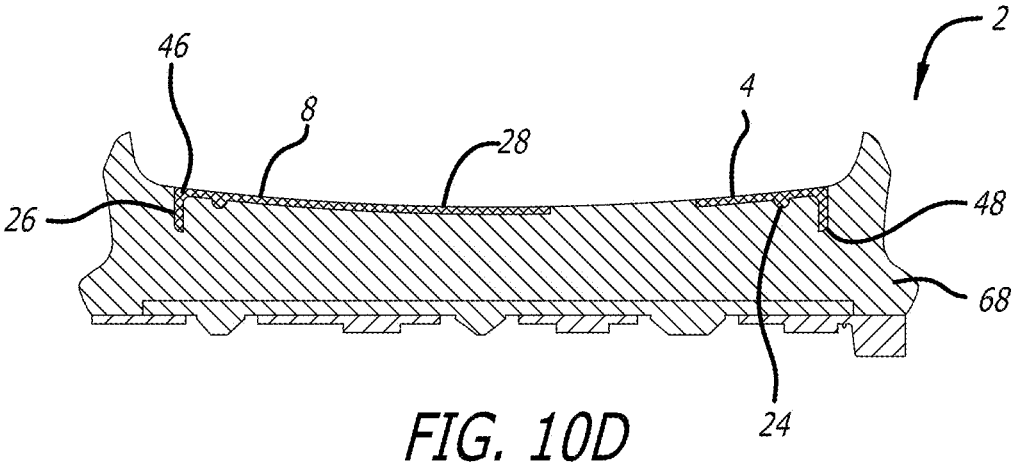
FIG. 10D is a cross-sectional view of the sole shown in FIG. 10A, as defined by section line 10D-10D in FIG. 10A.
Figure 10E:
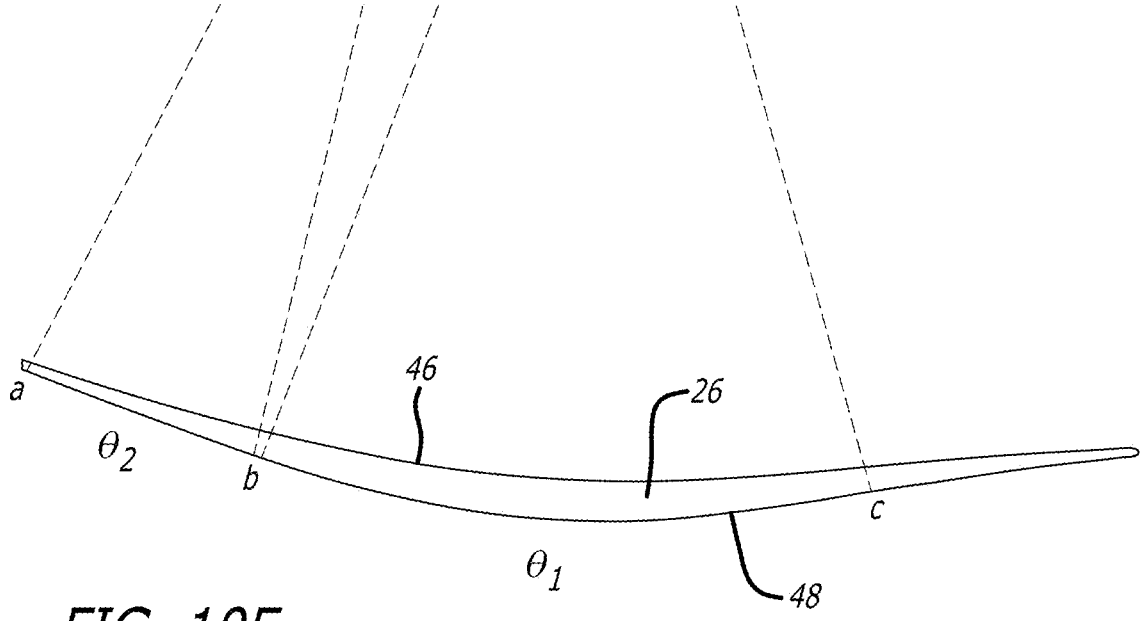
FIG. 10E is a side view of the medial supporting member as shown in FIG. 10B with curvature measurements for the bottom edge of the supporting member.
Figure 10F:
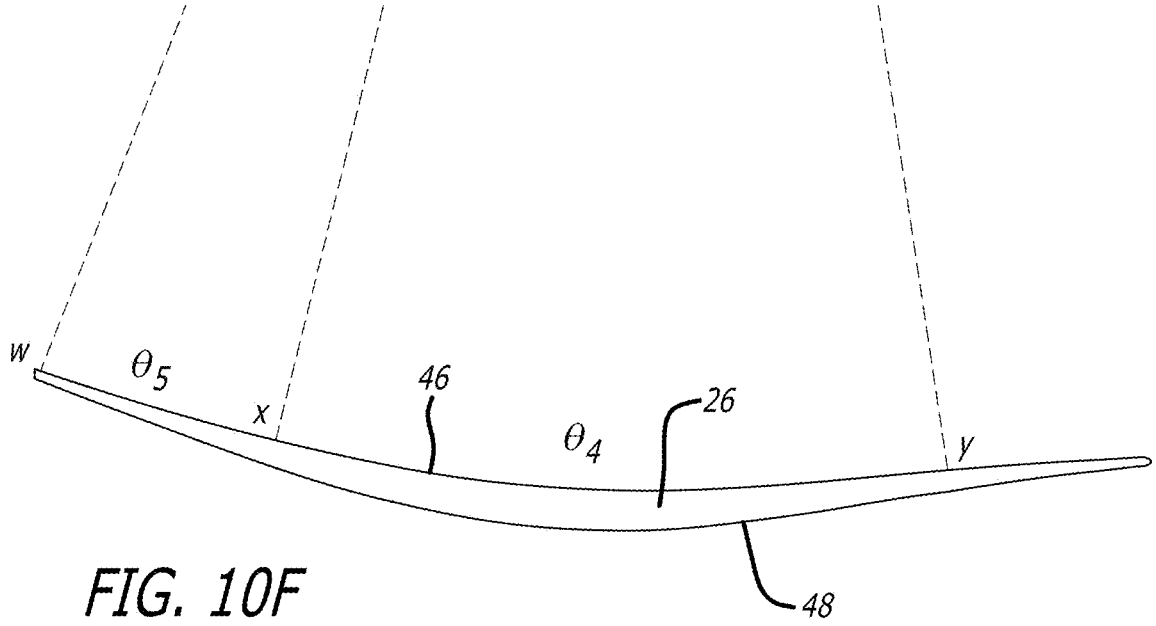
FIG. 10F is a side view of the medial supporting member as shown in FIG. 10B with curvature measurements for the top edge of the supporting member.

FIGS. 10A-10D depict an exemplary embodiment of supporting member 4 incorporated in sole 2. Horizontal sub-members 8 are curved along the lateral axis of sole 2, corresponding to the curvatures of the perimeter of a midsole. The anterior distal ends and the posterior distal ends of horizontal sub-members 8 are curved inward as shown in FIG. 10A. The lateral curvature of horizontal sub-members 8 are relatively coextensive with the perimeter of the midsole. Vertical sub-members 26 are configured to be coextensive to the sole's peripheral walls. Vertical sub-members 26 are at an approximately right angle with the latitudinal plane of horizontal sub-members 8 as shown in FIGS. 10C and 10D. Vertical sub-members 26 extend downward from the horizontal sub-members 8 toward the outsole with top edge 46 of the vertical sub-members 26 being adjacent to the horizontal sub-members. The height of vertical sub-members 26 vary along the longitudinal axis of supporting members 4, reaching the greatest height at lowest point of the upward curvature and tapering towards anterior distal ends and posterior distal ends as shown in FIG. 10B.

Horizontal sub-members 8 are integrally connected to cross bars 28. A first cross bar 28 extends across the sole in a first mediolateral direction from a lateral horizontal sub-member 8. A second cross bar 28 extends across sole 2 in a second mediolateral direction from a medial horizontal sub-member 8. Cross bars 28 are positioned in an area located under the region of the ball of the foot and are spaced away from each other. The first cross bar 28 is located closer to the toe area and the second cross bar 28 is located closer to the heel area. Supporting members 4 have support ridges 24 on the lower surfaces of supporting members 4 that extend along the longitudinal length of horizontal sub-members 8.

Supporting members 4 are compression molded with a cushioning element 68. Cushioning element 68 is located between the upper and outsole. Supporting members 4 are located above cushioning element 68 and vertical sub-members 26 and support ridges 24 extend downward into cushioning element 68 as shown in FIGS. 10C &10D. Supporting members 4 are positioned to have vertical sub-members 26 spaced an inward distance away from the exterior of sole 2 so as not to be visible on the lateral and medial sides of sole 2. Supporting members 4 are depicted as being spaced from a lower surface of cushioning element 68. Supporting members 4 are positioned to have their top edges 46 coplanar with the top surface of the cushioning element 68.

Figure 11A:
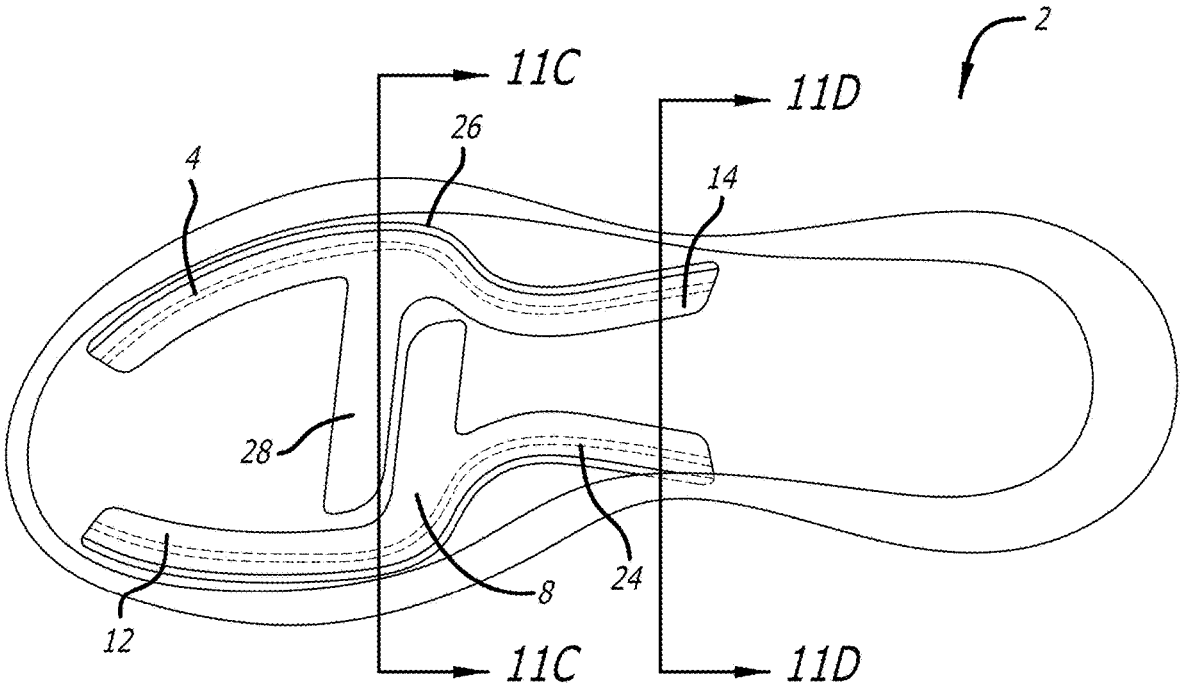
FIG. 11A is a top view of a partially assembled sole having a pair of rigid supporting members.
Figure 11B:
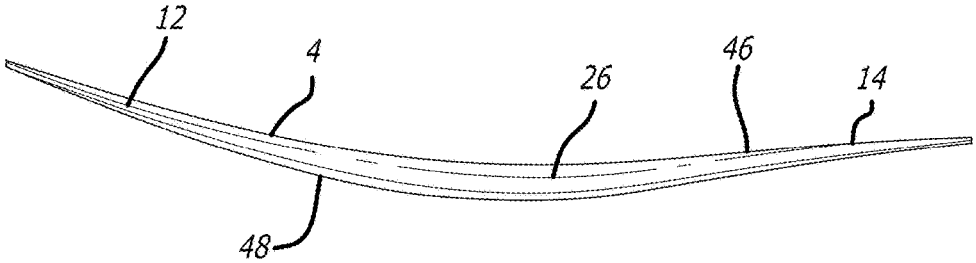
FIG. 11B is a side view of the medial supporting member shown in FIG. 11A.
Figure 11C:
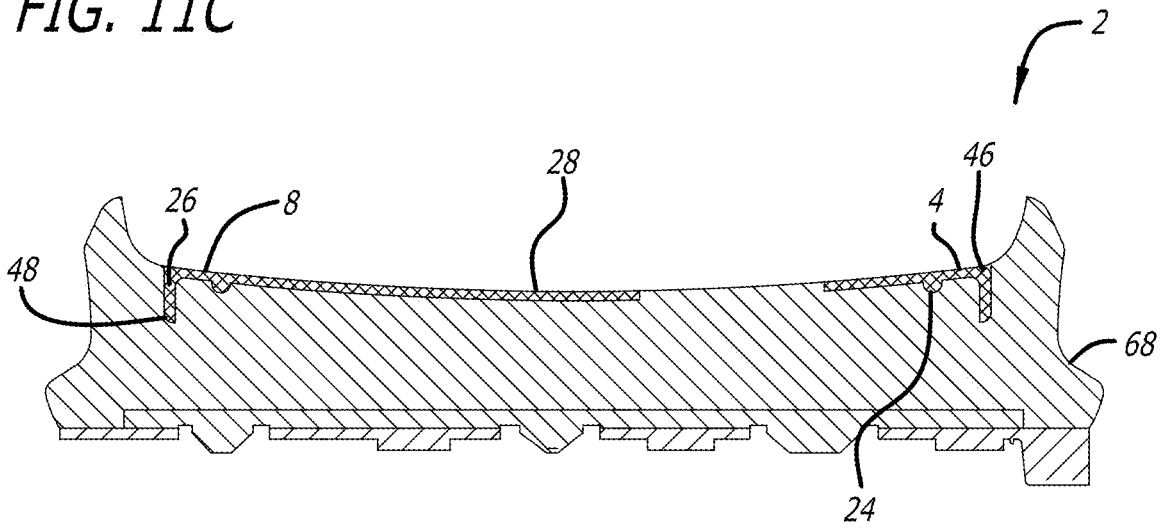
FIG. 11C is a cross-sectional view of the sole shown in FIG. 11A, as defined by section line 11C-11C in FIG. 11A.
Figure 11D:
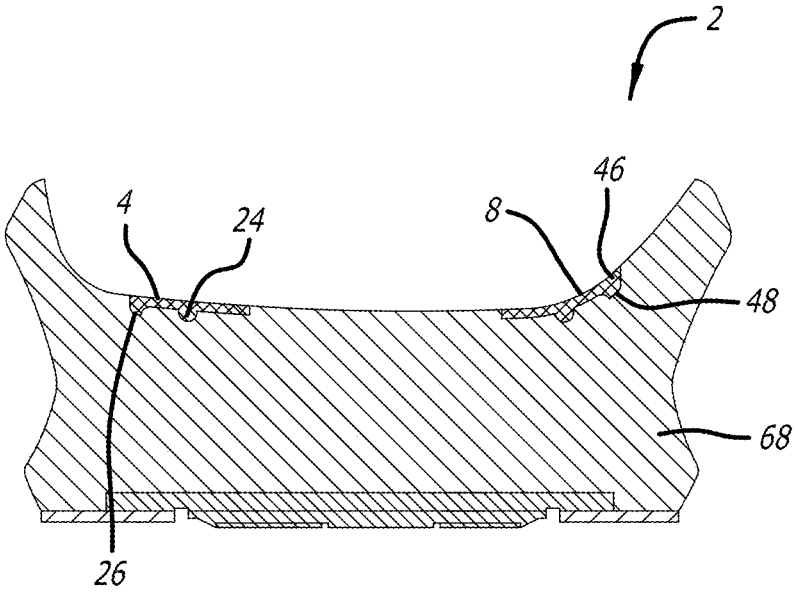
FIG. 11D is a cross-sectional view of the sole shown in FIG. 11A, as defined by section line 11D-11D in FIG. 11A.

In another exemplary embodiment, a pair of supporting members 4 are shown in FIGS. 11A-11D with posterior portions 14 of horizontal sub-members 8 that are configured to have laterally curve inward away from the perimeter of the midfoot region of the sole shown in FIG. 11A. Further to this embodiment, a first cross bar 28 extends a greater distance across the sole in a first mediolateral direction from lateral horizontal sub-member 8 than a second cross bar's 28 distance extending across the sole in a second mediolateral direction from medial horizontal sub-member 8 as shown in FIG. 11A. The lateral horizontal member sub-member 8 also partially curves upward along the lateral axis in the midfoot region as shown in FIG. 11D. Vertical sub-member 26 and ridge 24 increase the durability of this lateral curvature in the lateral horizontal sub-member.

Figure 12A:
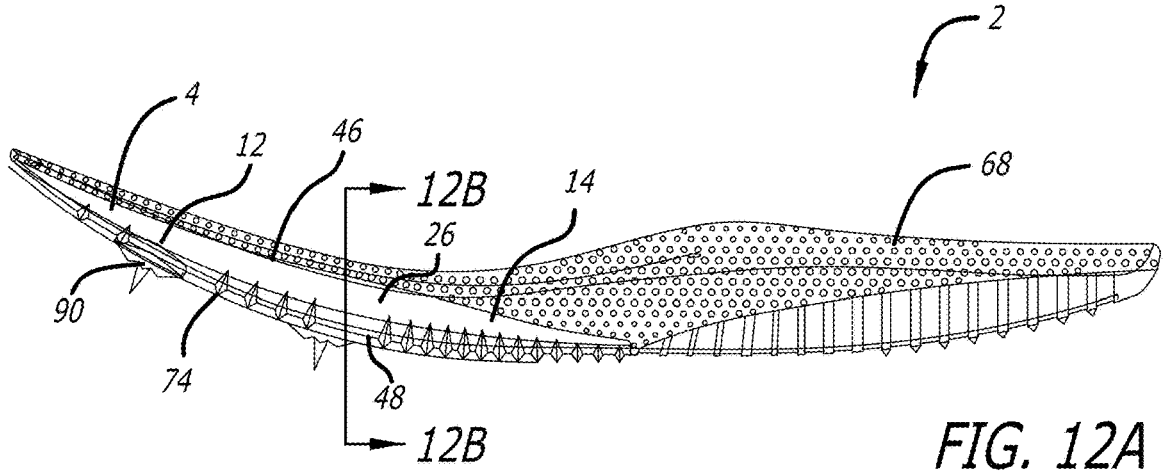
FIG. 12A is a medial side view of a sole having a pair of rigid supporting members.
Figure 12B:
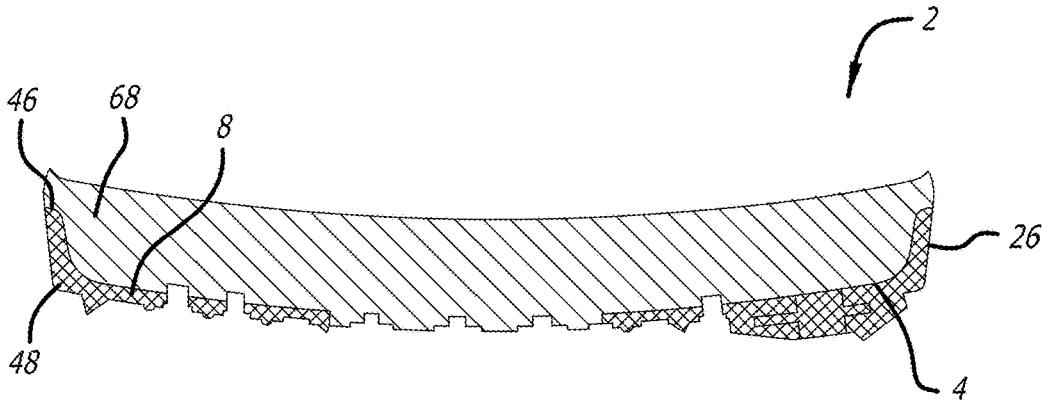
FIG. 12B is a cross-sectional view of the sole shown in FIG. 12A, as defined by section line 12B-12B in FIG. 12A.
Figure 12C:
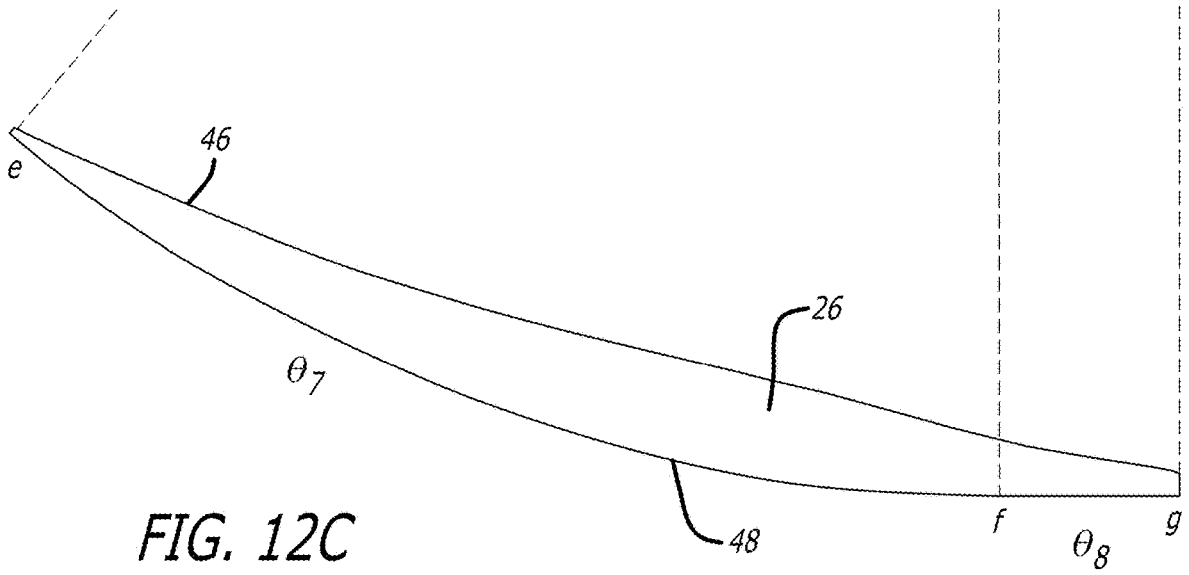
FIG. 12C is a side view of the medial supporting member as shown in FIG. 12A with curvature measurements for the bottom edge of the supporting member.
Figure 12D:
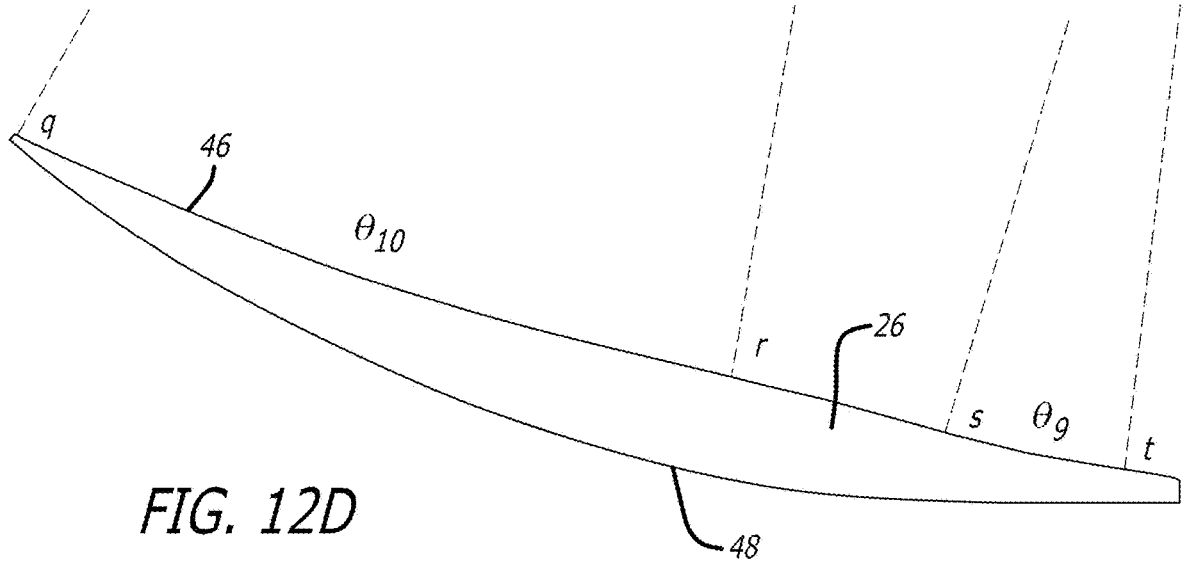
FIG. 12D is a side view of the medial supporting member as shown in FIG. 12A with curvature measurements for the top edge of the supporting member.

FIGS. 12A and 12B depict another exemplary embodiment in which a pair of supporting members 4 form a portion of the outsole. Vertical sub-members 26 are at an approximately right angle with the plane of horizontal sub-members 8 as shown in FIG. 12B. The height of vertical sub-members 26 vary along the longitudinal axis of supporting members 4 with the height being shortest at the anterior distal ends and posterior distal ends and greater in central regions between distal ends. Bottom edge 48 of vertical sub-members 26 have an upward curvature along the longitudinal axis of sole 2 that is more pronounced than the upward curvature of top edge 46 of vertical sub-members 26. The upward curvatures of vertical sub-members 26 causes the wearer's toes to curve upward. Further to this exemplary embodiment, horizontal sub-members 8 are positioned below the cushioning element 68 which allows supporting member 4 to contact the ground to form at least a portion of the outsole. Vertical sub-members 26 are located, and recessed into, the exterior of the medial and lateral sides of cushioning element 68 as shown in FIG. 12B and are configured to support the load. Horizontal sub-members 8 have a plurality of protruding members 74 and track spikes 90 attached to bottom edges 48 of vertical sub-members 26. The protruding members and track spikes may be integrally formed with the supporting member or separately formed components that protrude through apertures in the supporting members. Horizontal sub-members 8 may also have a plurality of apertures that may provide traction by forming treads or grooves or may be included for ornamental purposes.

Figure 13:
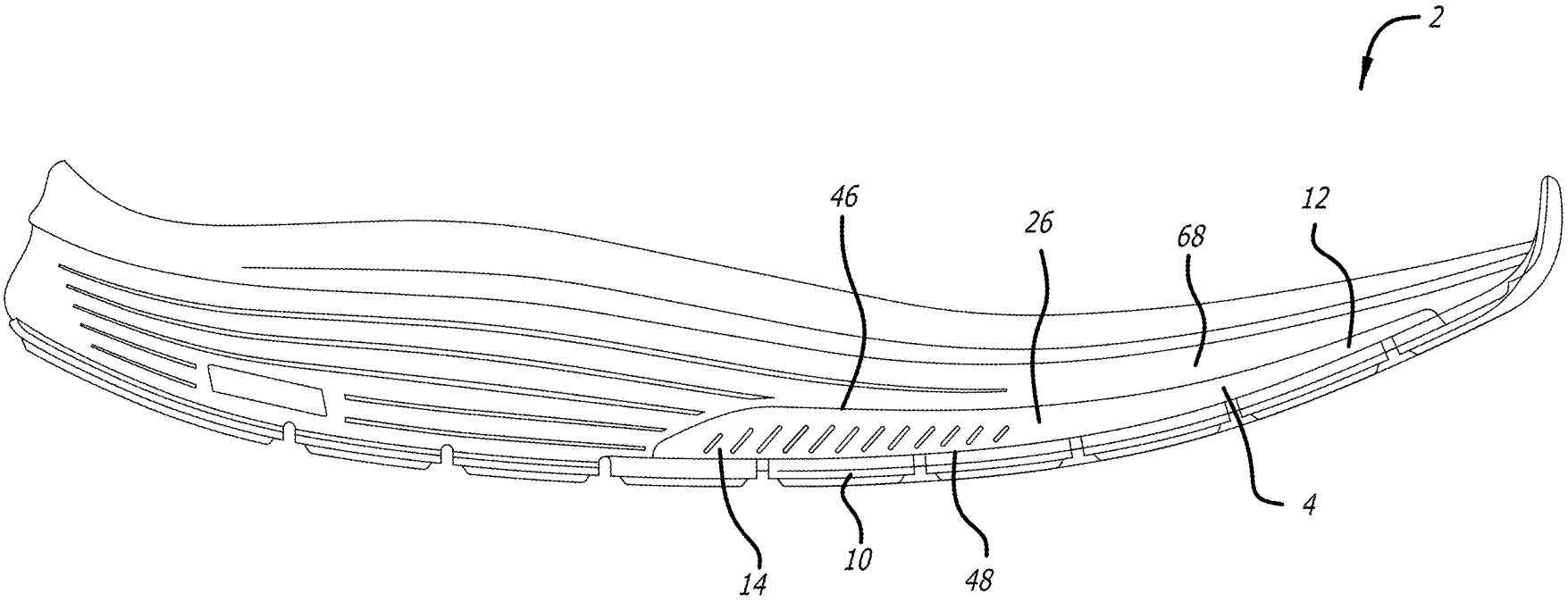
FIG. 13 is a lateral side view of a sole having a pair of rigid supporting members.

FIG. 13 depicts a side view of another exemplary embodiment in which supporting member 4 is incorporated into sole 2 between cushioning member 68 and outsole 10. The height of vertical sub-member 26 may vary along the longitudinal axis of supporting member 4 with the height being shortest at the distal ends of the anterior portion and posterior portion. Bottom edge 48 of vertical sub-member 26 has an upward curvature along the longitudinal axis of sole 2 at the forefoot region, and bottom edge 48 plateaus at the midfoot region. Top edge 46 of vertical sub-member 26 has an upward curvature configuration along the longitudinal axis of sole 2 in the forefoot region and plateaus in the midfoot region. Top edge 46 also inclines down at the posterior distal end to meet bottom edge 48 of vertical sub-member 26. Top edge 46 has an upward curvature that is shallower than bottom edge's 48 curvature which forms a partial crescent shape structure that adds durability to supporting member 4 which may additionally comprise a horizontal sub-member or a cross bar. Supporting member 4 is also embedded in the cushioning material 68 such that the vertical sub-member 26 may be located underneath portions of the foot supports to help reduce the load of the sole or prevent flexion of the sole.

FIGS. 14A-14F depict an exemplary embodiment of a pair of supporting members 4 incorporated in sole 2 that extends from a forefoot region to a heel region. Supporting members 4 are embedded between two midsole layers. Vertical sub-members 26 of supporting members 4 form a portion of the exposed exterior of sole 2. Vertical sub-members 26 have a crescent shape structure that extends form the forefoot region to the heel region of the sole. Top edge 46 of vertical sub-members 26 has an approximately U-shaped curvature extending from the forefoot region to the midfoot region with the lowest point of the curvature being located underneath the ball of the foot. Top edge 46 then crests and curves downward from the midfoot region to the heel region. Bottom edge 48 has an approximately U-shaped curvature that extends from the forefoot region to the heel region with an arc length greater than U-shaped curvature of top edge 46.

Further to the exemplary embodiment of FIGS. 14A-14F, as the height of vertical sub-member 26 increases in the midfoot, supporting member 4 forms an elongated oblong aperture 76 that extends also extends in the mediolateral direction of sole 2. Using rigid materials, aperture 76 will retain its shape. The absence of materials within the aperture will minimize the weight of the sole. The mediolateral extension of aperture 76 is formed by horizontal sub-members 8 and flanges 78 that form the upper wall and lower wall of aperture 76. Medial horizontal sub-member 8 and flanges 78 of medial supporting member 4 are spaced away from lateral horizontal sub-members 8 and flanges 78 of lateral supporting member 4. The interior central portion of aperture 76 is formed by cushioning material layers 80, 82. In other embodiments, the aperture may be fully formed by the supporting members 4 being connected at the interior central portion of aperture 76. Alternatively, supporting members 4 may be partially connected such that only certain regions of the supporting members 4 are connected to each other and extend across the walls of aperture 76. Alternatively, separate rigid structures spaced away from the supporting members 4 may be used to provide structural support of aperture 76. A fluid filled bladder structure or other cushioning materials may also be located within aperture 76 to provide added structural support and/cushioning.

Horizontal sub-members 8 are integrally connected to cross bars 28. A first cross bar 28 extends across the sole in a first mediolateral direction from lateral horizontal sub-member 8. A second cross bar 28 extends across the sole in a second mediolateral direction from medial horizontal sub-member 8. The cross bars 28 are positioned in an area located under the region of the ball of the foot. The first cross bar 28 is spaced away from the second cross bar 28 such that cross bars 28 span a greater area of region at and near the ball of the foot. One cross bar may be located closer to the toe area and while the other cross bar may be located closer to the heel area. Cross bars may also extend toward each other but spaced away at an interior central portion of the sole. Supporting members 4 have a plurality of support ridges 24 on the top surfaces and/or lower surfaces of horizontal sub-members 8, cross bars 28, and flanges 78. Ridges on flanges 78 are located only at the surfaces that face cushioning members 80, 82.

In another exemplary embodiment, a pair of supporting members 4 are shown in FIGS. 15A-15D wherein supporting members 4 do not include horizontal sub-members 8, cross bars 28, and support ridges 24. Supporting members 4 solely include curved vertical sub-members 26.

Figure 15A:
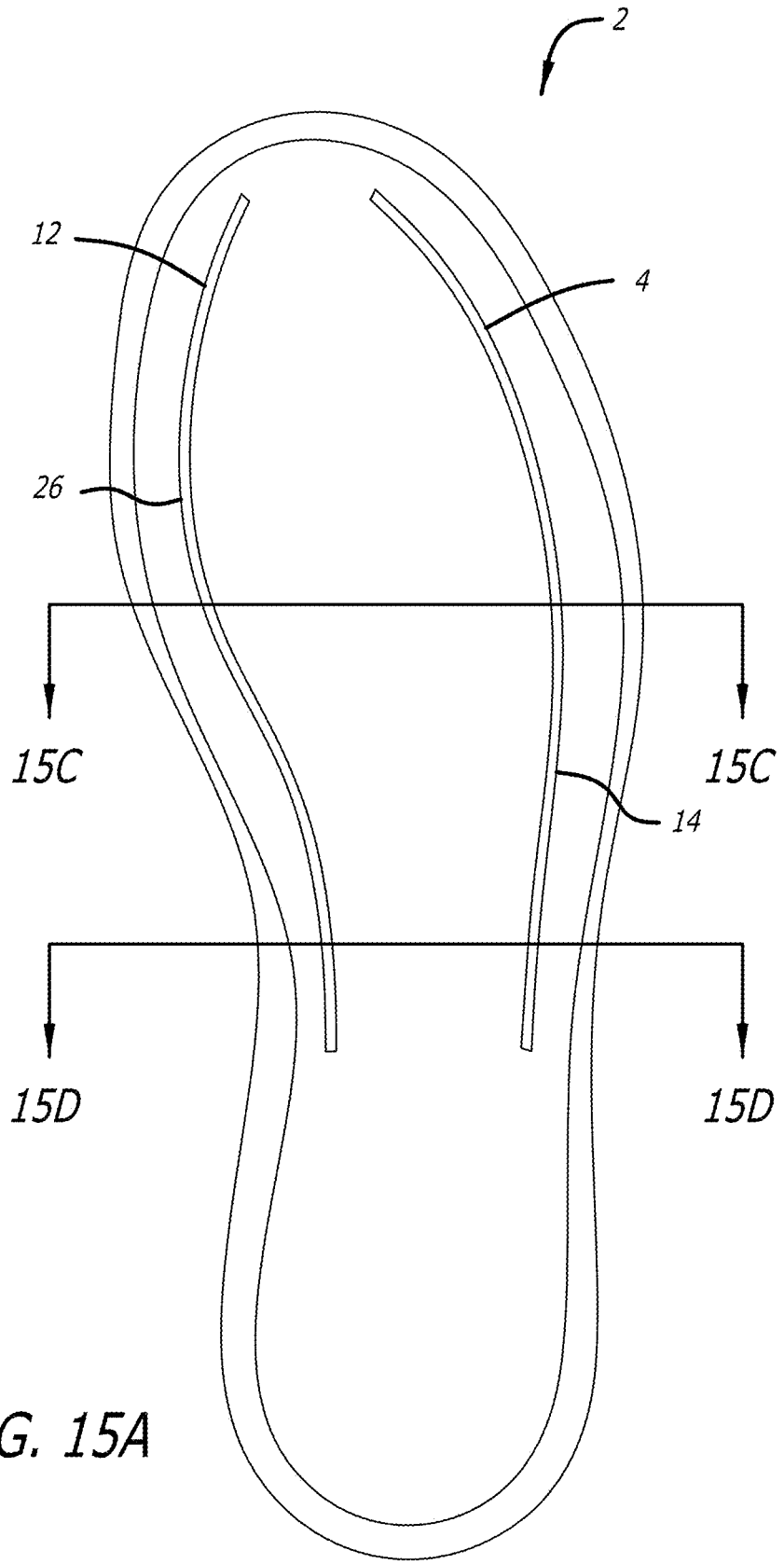
FIG. 15A is a top view of a partially assembled sole having a pair of rigid supporting members.
Figure 15B:
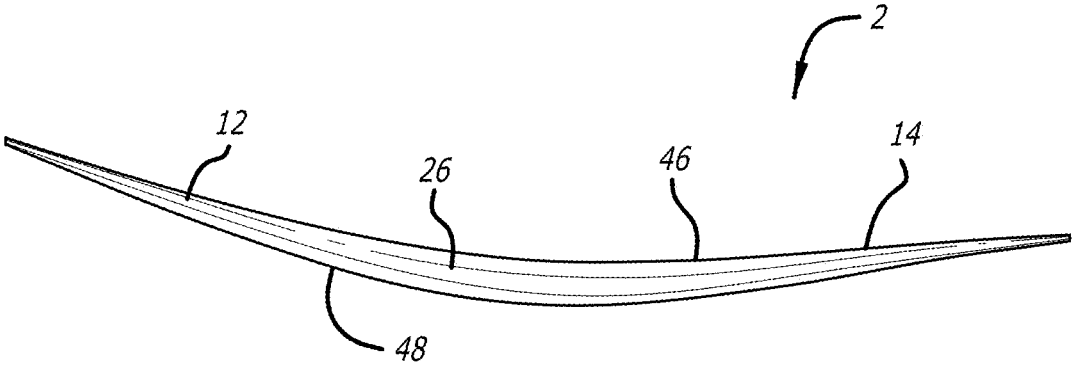
FIG. 15B is a side view of the medial supporting member shown in FIG. 15A.
Figure 15C:
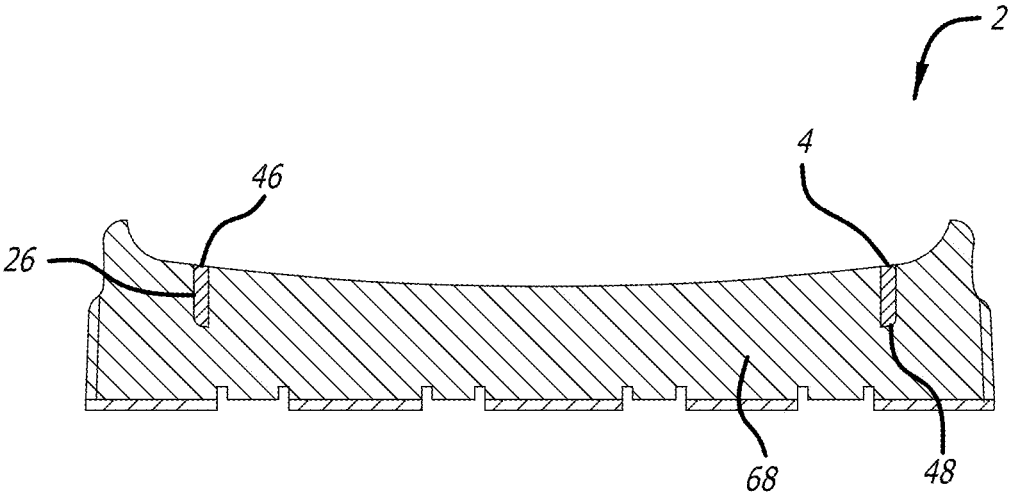
FIG. 15C is a cross-sectional view of the sole shown in FIG. 15A, as defined by section line 15C-15C in FIG. 15A.
Figure 15D:
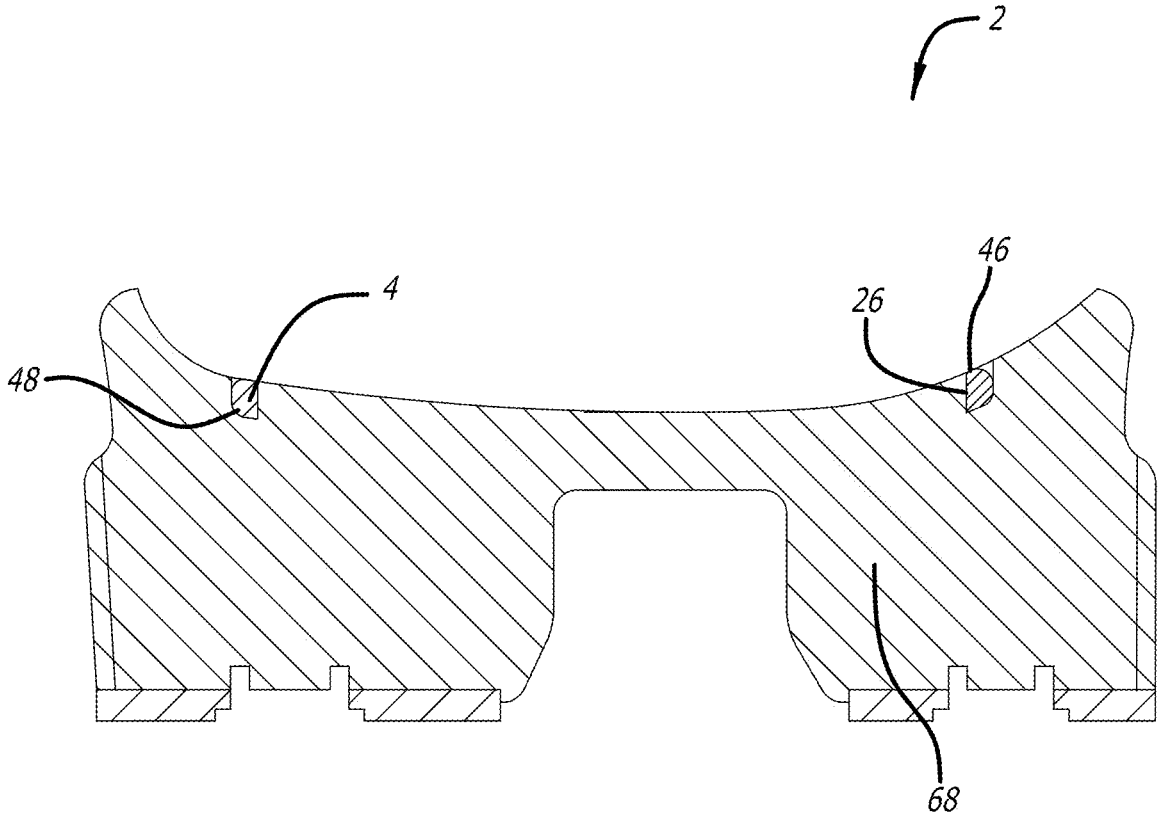
FIG. 15D is a cross-sectional view of the sole shown in FIG. 15A, as defined by section line 15D-15D in FIG. 15A.

FIGS. 15A-15D depict an exemplary embodiment of a pair of supporting members 4 incorporated in sole 2. Supporting members 4 are depicted in FIGS. 15A and 15C-15D as having anterior portions 12 extending substantially through the forefoot region and posterior portions 14 extending substantially through the midfoot region. Each vertical sub-member 26 is configured to extend relatively parallel to sole's 2 longitudinal axis and is curved along the lateral axis of sole 2, corresponding to the curvatures of the perimeter of the midsole. Further, vertical sub-members 26 are configured to have anterior portions 12 curved upwards towards the toes and posterior portions 14 curved upward towards the midfoot region. The distal ends of anterior portions 12 and posterior portions 14 are curved inward towards the interior central portion of the sole as shown in FIG. 15A, and the inward curvature may be coextensive with the peripheral shape of the sole or be aligned with the contours of the wearer's foot.

The vertical sub-member may also have horizontal sub-members or cross bars that have a similar height as the vertical sub-member. These components may also have a minimal thickness that extends along the longitudinal axis of the sole. These structures may extend in the mediolateral direction along regions that require additional rigid support to a cushioning element of the sole such as the ball of the foot or in the formation of apertures in with the sole.

Further to the embodiment of FIGS. 15A-15D, the height of each vertical sub-member 26 varies along the longitudinal axis of supporting member 4, reaching the greatest height at lowest point of the upward curvature of supporting member 4. The height of vertical sub-member 26 decreases at both the distal ends of the anterior portion 12 and posterior portion 14 as shown in FIG. 15B. Top edge 46 and bottom edge 48 have compound curves that differ from each other such that the vertical sub-member forms a crescent shape. The top edge 46 may have a central first angle that is shallower than the central first angle of the bottom edge 48.

The thickness of vertical sub-members 26 may be non-uniform or substantially uniform as shown in FIGS. 15A and 15C-15D. The longitudinal length of vertical sub-members 26 are greater than the thickness of vertical sub-members 26. The height of vertical sub-members 26 is also greater than the thickness of vertical sub-members 26 in some regions of sole 2 and equal to or less than in other regions of vertical sub-members 26 such as the distal ends of anterior and posterior portions 12, 14. For example, FIG. 15C depicts portions of the height of vertical sub-members 26 being at least three-fold greater than the relative latitudinal thickness. In other possible embodiments, the height of vertical sub-members 26 are greater than the latitudinal thickness of vertical sub-members 26 in all regions along the length of the supporting members 4.

Supporting members 4 are depicted in FIGS. 15A and 15C-15D as being spaced from medial and lateral edges of cushioning element 68, as well as being spaced from a lower surface of a cushioning element 68. Supporting members 4 are positioned to have top surfaces of vertical sub-members 26 coplanar with the top surface of cushioning element 68. That is, supporting members 4 are depicted as being embedded in cushioning element 68 aside from the top surface of vertical sub-members 26. In other configurations, the top surface of the vertical sub-members may be spaced from an upper surface of a cushioning element to have supporting members completely embedded in the cushioning element or extend above a cushioning element. In alternate embodiments, vertical sub-members may be bonded to the exterior of the cushioning element and/or an outsole. Vertical sub-members may form portions of the outsole layer.

Any number of supporting members may be used, such as a single supporting member or more than one supporting members. Further, a supporting member may be placed in any location of the sole that enhances running or walking economy either by providing elastic energy return and/or rigidity to areas of the foot that alleviates or reduces the negative impact to joints, tendons, and muscles. The supporting members of FIGS. 15A-15D are in the forefoot region to provide desired stiffness and/or elastic energy return under the metatarsophalangeal joint. Other examples of where a supporting member may be placed includes the midfoot region to provide desired stiffness and/or elastic energy return to the midfoot arch and in the heel region similar to the curved support provided by supporting member 4 in FIGS. 14A-14F.

In other embodiments of FIGS. 15A-15D, vertical sub-members of the supporting members may have horizontal components such as support ridges along the exterior and/or interior portions of the vertical sub-member to increase rigidity and elasticity of the supporting member. Further, support ridges may also provide an anchoring point for added convenience for assembly of the sole.

Materials of the supporting member. An exemplary supporting member may be composed of thermoplastic elastomers, including polyether block amides (PEBA) such as, but not limited to Pebax®, which is manufactured by Arkema™, thermoplastic polyamides, thermoplastic polyurethanes, thermoplastic copolyesters such as Arnitel®, which is manufactured by Royal DSM™, and thermoplastic polyester elastomers such as Hytrel®, which is manufactured by DuPont™. A supporting member may also be composed of carbon fiber reinforced thermoplastic elastomers such as Rilsan®, which is a carbon fiber reinforced polyamide manufactured by Arkema™. A supporting member may also be constructed of a composite mixture of the materials.

Dimensions of the supporting member. The height of the vertical sub-member component may vary along the longitudinal axis of the supporting member or be of a uniform height. Exemplary heights of the vertical sub-member range from about 0.3 mm to about 25.0 mm. In one example, the height of the vertical sub-member is about 6 mm at a location at or near the ball of the foot and decreases to about 1 mm at the anterior and posterior distal ends. The thickness of the vertical sub-member may vary along the longitudinal axis of the supporting member or be of a uniform thickness. The thickness of the vertical sub-member ranges from about 0.3 to about 4.0 mm. In one example, the thickness of the vertical sub-member is a substantially uniform thickness of about 1.2 mm. It may be preferred that the thickness of the vertical sub-member is kept to a minimum to provide for a lightweight sole.

In some exemplary embodiments, the anterior distal end of a supporting member may have an anterior angle measured between a horizontal plane that is tangential to the lowest point of the curved supporting member and a line drawn from the lowest point to the anterior distal end. The anterior angle may include a value within a range from about 13-degrees to about 21-degrees. Similarly, the posterior portion may have a posterior angle measured between the horizontal plane and a line drawn from the lowest point of the curved supporting member to the anterior distal end. The posterior angle may be within a range from about 6-degrees to about 19-degrees.

In some exemplary embodiments, the supporting member may include a horizontal sub-member integrally connected to the curved vertical sub-member. The thickness of the horizontal sub-member may include a substantially uniform thickness within the range of about 0.3 mm to about 6.0 mm across the horizontal sub-member or a non-uniform thickness that varies across the horizontal sub-member. In one example, the horizontal sub-member has a substantially uniform thickness of about 1.0 mm.

In some exemplary embodiments, the supporting member may include one or more support ridges above/or below the top and lower surfaces of the supporting member that extend along the longitudinal length of the supporting member. A ridge may be located on a vertical sub-member and/or a horizontal sub-member and/or a cross bar of the supporting member. The one or more support ridges may protrude from the surface of the supporting member at a distance ranging from about 1.0 mm to about 1.7 mm. In one example, a support ridge protrudes from the bottom surface of a horizontal sub-member at a distance of 1.2 mm.

Flex testing. Flex testing measures the durability, i.e. cracking, of the supporting member embodiments through reciprocating flexing movements under a specified angle and frequency. Mixtures of materials, such as a PEBA based material and a carbon fiber-based material, may improve the durability of the supporting members. Under the flex testing method SATRA TM-16, preferred embodiments of the composite supporting members lasted more than 125,000 cycles.

Preferred embodiments of sole with a supporting member ideally have sufficient rigidity or flex resistance for desired elastic energy return that enhances running economy. Flex resistance measurements (ISO 17707:2005) of preferred embodiments sole demonstrates an increase in rigidity. In some exemplary embodiments, the rigidity increases 2- to 3-fold over a sole without the supporting member.

Preferred embodiments also exhibit a higher elasticity or spring coefficient than without the supporting member. Higher elasticity provides improved energy return ideal for achieving enhanced running or walking economy. A tension test machine was used to measure the deflection of force energy of weight with a contact surface diameter of 2.14 mm by soles that were compressed to 50%. The elastic coefficients (k; $U=1/2(k/\Delta x^2)$) of soles with supporting members increase with some embodiments demonstrating about a two-fold higher k value.

Cushioning Elements. The supporting member may be used as part of an insole or be used in combination with a cushioning element. The cushioning element may be at least a portion of a midsole. The supporting member may also be located between two cushioning elements. The two cushioning elements may be two layers that form a midsole. The supporting member may also be between a midsole layer and an outsole layer.

The cushioning element may be of any material used in the art. Some exemplary materials may include a POE such as EVA or a TPE. The polymer materials may be foamed either through use of chemical foaming agents or supercritical fluid expansion. The cushioning elements may also include the use of gels or fluid filled bladders.

In an exemplary embodiment, the midsole may be comprised of a first cushioning element in the heel area and a second cushioning element in the forefoot and midfoot areas. The first cushioning element may be a SCF foamed material and the second cushioning element may be a chemically foamed material. In this embodiment, the chemically foamed material has a higher density and hardness, and a lower resiliency than the SCF-expanded polymer material. The SCF-expanded polymer material may be, but is not limited to, EVA and/or TPU. In this exemplary embodiment, the SCF-expanded polymer material comprises substantially the entire midsole layer of the heel area as well as portions of the midsole area. Further to this embodiment, the SCF foamed material may include a plurality of apertures to provide flexibility, reduction of weight, and desired weight distribution. In an alternate embodiment, the first cushioning element may be the chemically foamed material and the second cushioning element may be the SCF foamed material.

In another exemplary embodiment, the midsole may be comprised of a first cushioning element above the supporting member and a second cushioning element below the supporting member. Both the first cushioning element and second cushioning element may be a SCF foamed material. The SCF-expanded polymer materials may be, but are not limited to, EVA and/or TPU. Further to this embodiment, the SCF foamed materials may include a plurality of apertures to provide flexibility, reduction of weight, and desired weight distribution.

In an exemplary embodiment, the cushioning element may be used above the supporting member. The cushioning element may have an Asker C hardness of 44 to 51.

The supporting member may be stock-fitted with the cushioning element. In one preferred embodiment, a supporting member having two separately constructed sub-members allow for greater ease in manufacturing. The separately constructed sub-members allow for varying the placement of each supporting member because of the minor differences in size of the cushioning elements. For example, mass produced midsoles are not consistently manufactured to the desired range of dimensions. A uniformly constructed supporting member that is configured to extend across a first area of the sole and a second area of the sole may not be properly fitted to a midsole that do not fall within the desired range of dimensions of the midsole. By using separately constructed sub-members, the separate sub-members may be placed in the exact regions of the midsole during the stock fitting process and thereby accounting for deviations in production of the midsole.

Further to this embodiment, the supporting member may each have cross bars that are not connected or connected by an extendable connecting member. The placement of the supporting member having cross bars on a cushioning element may be more easily adjusted during the stock fitting process. The adjustments may include placing vertical and/or horizontal sub-members in closer proximity or farther from each other in some midsoles. Adjustments may also include placing cross bars closer or farther from each other. The placement may be determined by distance between the medial and lateral edges of a midsole and the location of the area that is located underneath the metatarsophalangeal joint region. In other examples, other reference points of the sole may be used to determine correct positioning of the support member such as the midfoot region, the midfoot arch, the ankle, etc.

Although the present invention has been described above by referring to particular embodiments, it should be understood that modifications and variations could be made to the sole supporting member without departing from the intended scope of invention.

We claim:

1. A sole for an article of footwear, the sole comprising:
- a cushioning element;
- a supporting member comprising a vertical sub-member and a horizontal sub-member, the vertical sub-member extending in both a vertical direction and a longitudinal direction, the longitudinal direction extending along a toe region to a heel region of the sole;
- the vertical sub-member having a curvature along the longitudinal direction;
- the vertical sub-member is located in a forefoot region of the sole;
- the curvature of the vertical sub-member is concave upward;
- the curvature of the vertical sub-member has a first arc length defined by a first central angle wherein at least a portion of the first arc length is adapted to be positioned underneath a ball region of a foot;
- the horizontal sub-member extending from a sidewall of the vertical sub-member in a latitudinal direction and being angled away from the vertical sub-member, the horizontal sub-member extending in the longitudinal direction; and
- whereby the supporting member has a greater rigidity than at least a portion of the cushioning element.

2. The sole of claim 1, wherein the vertical sub-member has a bottom edge comprising a first arc length defined by a first central angle and the vertical sub-member has a top edge comprising a second arc length defined by a second central angle, the vertical sub-member has at least one tapered end where the first arc length and the second arc length meet, and the first central angle differs from the second central angle.

3. The sole of claim 2 in which the first central angle is greater than the second central angle.

4. The sole of claim 3 in which the horizontal sub-member is located closer to the top edge than to the bottom edge; and at least a portion of the horizontal sub-member and at least a portion of the vertical sub-member, in combination, defines an L-shaped configuration.

5. The sole of claim 3 in which at least a portion of the vertical sub-member has a vertical height that is at least three times greater than a latitudinal thickness of the vertical sub-member.

6. The sole of claim 2 in which the top edge and the bottom edge define at least an approximately crescent shaped sidewall of the vertical sub-member.

7. The sole of claim 1 in which the horizontal sub-member is approximately perpendicular to the vertical sub-member and a portion of the horizontal sub-member has a curvature that is coextensive with the curvature of the vertical sub-member at a location between a top edge and a bottom edge of the vertical sub-member.

8. The sole of claim 1 in which the horizontal sub-member is spaced away from a peripheral side of the sole.

9. The sole of claim 1 in which the supporting member has one or more ridges that extend along the longitudinal direction.

10. The sole of claim 1 in which the supporting member has a cross bar that extends away from the horizontal sub-member in the latitudinal direction, the latitudinal direction extending beyond the horizontal sub-member.

11. The sole of claim 1, wherein the supporting member is a first supporting member, the sole further comprising a second supporting member spaced apart from the first supporting member.

12. A sole for an article of footwear, the sole comprising:

a cushioning element;

a supporting member comprising a vertical sub-member and a horizontal sub-member, the vertical sub-member extending in both a vertical direction and a longitudinal direction, the longitudinal direction extending along a toe region to a heel region of the sole;

the vertical sub-member having a curvature along the longitudinal direction;

the vertical sub-member is located in a forefoot region of the sole;

the curvature of the vertical sub-member is concave upward;

the horizontal sub-member extending from a sidewall of the vertical sub-member in a latitudinal direction and being angled away from the vertical sub-member, the horizontal sub-member extending in the longitudinal direction;

wherein the supporting member is embedded within an upper portion of the cushioning element and has an uppermost surface that is flush with an upper surface level of the cushioning element; and whereby the supporting member has a greater rigidity than at least a portion of the cushioning element.

13. The sole of claim 12 wherein the cushioning element is a midsole.

14. The sole of claim 12 wherein the supporting member is a first supporting member, the vertical sub-member is a first vertical sub-member, and the horizonal sub-member is a first horizontal sub-member, the sole further comprising a second supporting member spaced apart from the first supporting member, and wherein the second supporting member comprises a second vertical sub-member and a second horizontal sub-member.

15. The sole of claim 14 wherein the first horizonal sub-member is located on a lateral side of the sole, the second horizonal sub-member is located on a medial side of the sole, the sole of further comprising a first cross bar attached to and extending away from the first horizontal sub-member toward the medial side of the sole, and a second cross bar attached to and extending away from the second horizontal sub-member toward the lateral side of the sole.

16. A sole for an article of footwear, the sole comprising:

a cushioning element;

a supporting member comprising a vertical sub-member and a horizontal sub-member, the vertical sub-member extending in both a vertical direction and a longitudinal direction, the longitudinal direction extending along a toe region to a heel region of the sole;

the vertical sub-member having a curvature along the longitudinal direction;

the vertical sub-member is located in a forefoot region of the sole;

the curvature of the vertical sub-member is concave upward;

the horizontal sub-member extending from a sidewall of the vertical sub-member in a latitudinal direction and being angled away from the vertical sub-member, the horizontal sub-member extending in the longitudinal direction;

the supporting member having a cross bar extending away from the horizontal sub-member in the latitudinal direction, the latitudinal direction extending beyond the horizontal sub-member;

the vertical sub-member having a top edge and a bottom edge;

the top edge extending above an uppermost level of the cross bar and the bottom edge extending below a lowermost level of the cross bar;

the vertical sub-member extending longitudinally both forward and rearward relative to the cross bar; and whereby the supporting member has a greater rigidity than at least a portion of the cushioning element.

17. The sole of claim 16 wherein the vertical sub-member, the horizontal sub-member, and the cross bar, in combination, form a T-shaped configuration.

* * * * *